US006732664B2

(12) United States Patent
Worrall

(10) Patent No.: US 6,732,664 B2
(45) Date of Patent: May 11, 2004

(54) KEY AND COMBINATION LOCKING MECHANISM

(76) Inventor: Charles H. Worrall, 2069 E. 10180 South, Sandy, UT (US) 84092

( * ) Notice: Subject to any disclaimer, the term of this patent is extended or adjusted under 35 U.S.C. 154(b) by 0 days.

(21) Appl. No.: 09/925,283

(22) Filed: Aug. 7, 2001

(65) Prior Publication Data

US 2002/0033607 A1 Mar. 21, 2002

Related U.S. Application Data

(60) Provisional application No. 60/223,581, filed on Aug. 7, 2000.

(51) Int. Cl.[7] ..... E06B 7/00; E05B 37/00

(52) U.S. Cl. ..... 109/68; 70/92; 70/284; 70/285; 109/67; 292/21; 292/92; 292/DIG. 65

(58) Field of Search ..... 70/92, 284, 285, 70/DIG. 63; 292/21, 92, DIG. 65; 109/67, 68

(56) References Cited

U.S. PATENT DOCUMENTS

| | | | | |
|---|---|---|---|---|
| 1,708,709 A | * | 4/1929 | Tibbetts | |
| 2,076,085 A | * | 4/1937 | Hunnicutt | |
| 3,633,388 A | * | 1/1972 | Atkinson | 70/80 |
| 3,897,901 A | * | 8/1975 | Grosswiller, Jr. et al. | 232/44 |
| 3,936,086 A | * | 2/1976 | Berkowitz | 292/341.17 |
| 4,006,471 A | * | 2/1977 | Pappas | 70/92 |
| 4,138,869 A | | 2/1979 | Pelcin | 70/151 R |
| 4,203,622 A | * | 5/1980 | Cook et al. | 292/221 |
| 4,459,835 A | | 7/1984 | Hurskainen | 70/134 X |
| 4,470,277 A | * | 9/1984 | Uyeda | 70/118 |
| 4,637,237 A | | 1/1987 | Witkoski et al. | 70/285 |
| 4,694,670 A | | 9/1987 | Jang | 70/303 R |
| 4,842,289 A | | 6/1989 | Samuels | 280/8 |
| 4,911,487 A | | 3/1990 | Rachocki | 292/216 |
| 4,961,330 A | * | 10/1990 | Evans | 292/21 |
| 4,978,151 A | * | 12/1990 | Coleman et al. | 292/21 |
| 5,199,753 A | * | 4/1993 | Presley, Jr. | 292/188 |
| 5,237,842 A | | 8/1993 | Rasch et al. | 70/285 |
| 5,445,326 A | * | 8/1995 | Ferro et al. | 292/336 |
| 5,590,917 A | * | 1/1997 | Brooks et al. | 292/21 |
| 5,820,174 A | | 10/1998 | Parikh et al. | 292/126 |
| 5,921,117 A | | 7/1999 | Illguth | 70/159 |
| 5,984,383 A | | 11/1999 | Parikh et al. | 292/121 |

FOREIGN PATENT DOCUMENTS

| | | | | |
|---|---|---|---|---|
| DE | 498939 | * | 5/1930 | 70/284 |

* cited by examiner

*Primary Examiner*—Lloyd A. Gall
(74) *Attorney, Agent, or Firm*—Clayton, Howarth & Cannon, P.C.

(57) ABSTRACT

The locking mechanism described herein is for use in an enclosure, which is part of a product delivery system. The locking mechanism uses existing locks and latches, and configures them using linkages into a mechanism that is not currently available. The mechanism has a latch that holds the door of the enclosure closed. This latch stays in a normally unlocked state until deliberate acts are taken to lock the latch. When a delivery is made, the delivery person opens the unlocked door, makes the delivery, and then closes the door and turns the rotary latch counter clockwise until it latches in the locked position. There are three independent and distinct ways to unlock the mechanism: (1) a key can be used to unlock the mechanism; (2) a combination lock can be used to unlock the mechanism; or (3) an emergency release paddle, for child safety is located on the lower back cover of the lock, and can be pushed to unlock the mechanism. If children were playing around the enclosure and one child was locked in the enclosure by another, the child in the enclosure need only to push the paddle to release the lock, and then push the door open. Once unlocked either by the key, the combination, or the release paddle the latch will remain unlocked. The combination of the lock can only be changed by use of the key lock.

40 Claims, 24 Drawing Sheets

KEY AND COMBINATION LOCKING MECHANISM

CROSS-REFERENCE TO RELATED APPLICATIONS

This application claims the benefit of U.S. Provisional Application No. 60/223,581, filed Aug. 7, 2000, entitled "Key and Combination Locking Mechanism," which is hereby incorporated by reference herein in its entirety, including but not limited to those portions that specifically appear hereinafter.

STATEMENT REGARDING FEDERALLY SPONSORED RESEARCH OR DEVELOPMENT

Not Applicable.

BACKGROUND OF THE INVENTION

1. The Field of the Invention

The present invention relates generally to locking mechanisms, and more particularly, but not necessarily entirely, to a lockable receptacle used for two-party delivery and retrieval of packages and other tangible items delivered by third party couriers using any one of three variations to unlock the receptacle, a three digit combination lock assembly, a key operated lock assembly and a quick release emergency paddle assembly.

2. Description of Related Art

Locking assemblies typically use key type locks or combination type locks. Previous patents have some of the same components but are not configured in the same manner, and they are not designed to be mounted on a single thickness metal door panel. U.S. Pat. No. 5,237,842 (granted Aug. 24, 1993 to Rasch et al.) discloses a key and combination lock for luggage. This locking system is designed for securing together two relatively moveable parts of a piece of luggage and the locking assembly requires the key and combination to be used together instead of one or the other as in the present design. Once locked this system does not allow the latch to be inserted, which would not allow the door on the present invention to be closed. U.S. Pat. No. 4,694,670 (granted Sep. 22, 1987 to Jang) discloses a combined key and combination lock, where the locking system is designed for ea conventional personnel door. The key and combination locks are on opposite sides of the personnel door and the lock is a dead bolt style lock, which does not allow the door to be closed after enabling the lock, which is disadvantageous. U.S. Pat. No. 4,637,237 (granted Jan. 20, 1987 to Witkoski et al.) discloses a door locking system designed to be used on a personnel door, where the lock is always enabled, and the combination lock is a push button style. Thus when the door is closed, it is defaulted to be locked without any manipulation on the part of the user. Therefore, the door is always in the locked position, which is not advantageous for a third party delivery.

With the increase in product deliveries to the home and to businesses, there remains a problem of securing the delivery if no one is available to accept the product or other item being delivered. The present locking mechanism is designed to allow both the lock to be manually enabled, and to allow multiple means of unlocking the mechanism.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY OF THE INVENTION

This locking mechanism is presently designed to work on an enclosure that provides a secure place to accept delivery and pickup of products. The mechanism is designed to allow unlocking via key, combination lock, or emergency release paddle on the back of the locking mechanism. The locking mechanism is used in two ways: first, to deliver products to the enclosure, and second to retrieve items from the secured enclosure. The locking mechanism uses existing locks and latches, then mounts and configures them using linkages into a mechanism that is not commercially available.

The mechanism is designed to be in an unlocked condition until manually locked. When a delivery is made, the delivery person places a package in the enclosure, closes the door and then turns the rotary latch counter clockwise to secure the compartment. This enables the locking mechanism.

There are three independent and distinct ways to unlock the mechanism: (1) a key can be used to unlock the mechanism; (2) a combination lock can be used to unlock the mechanism; or (3) an emergency release paddle, for child safety is located on the lower back cover of the lock, and can be pushed to unlock the mechanism. Once unlocked by use of the key, the combination lock, or the emergency release paddle the latch will remain unlocked, and the door can be opened to access the compartment, until the rotary latch is manually rotated in the counter clockwise direction and locked again.

The combination lock has three-digits, and the combination can only be changed by inputting the correct combination code, inserting the key into the lock, turning and holding the key in the clockwise direction, and inputting a new combination.

BRIEF DESCRIPTION OF THE DRAWINGS

The above and other features and advantages of the invention will become apparent from a consideration of the subsequent detailed description presented in connection with the accompanying drawings in which:

FIG. 1-2 is an isometric rear view of the lock assembly;

FIG. 1-3 is an exploded view of the locking mechanism;

FIG. 1-4 is an isometric view of the basic lock components;

FIG. 1-5 is an isometric view of the completed assembly, cover removed;

FIG. 1-6 is a left view of the locking mechanism;

FIG. 1-7 is a bottom view of the locking mechanism;

FIG. 1-8 is a back view of the locking mechanism in the unlocked position;

FIG. 1-9 is a back view of the locking mechanism in the locked position;

FIG. 1-10 is a back view of the locking mechanism in the key release position;

FIG. 1-11 is a back view of the locking mechanism in the combination lock release position;

FIG. 1-12 is a back view of the locking mechanism in the emergency paddle release position;

FIG. 1-13 is a back view of the locking mechanism in the key enabled combination change position;

FIG. 1-14 is a rear internal view of the locking mechanism;

FIG. 1-15 is a left internal view of the locking mechanism showing the combination lock in the locked position;

FIG. 1-16 is a left internal view of the locking mechanism showing the combination lock in the unlocked position;

FIG. 1-17 is a front view of a security delivery device, made in accordance with the present invention;

FIG. 1-18 is a side view of the security delivery device of FIG. 1-17;

FIG. 1-19 is a perspective view of the security delivery device of FIG. 1-17;

FIG. 2-1 is an isometric front view of the lock assembly;

FIG. 2-2 is an isometric rear view of the lock assembly;

FIG. 2-3 is an exploded view of the locking mechanism;

FIG. 2-4 is an isometric view of the basic lock components;

FIG. 2-5 is an isometric view of the completed assembly, cover removed;

FIG. 2-6 is a left view of the locking mechanism;

FIG. 2-7 is a bottom view of the locking mechanism;

FIG. 2-8 is a back view of the locking mechanism in the unlocked position;

FIG. 2-9 is a back view of the locking mechanism in the locked position;

FIG. 2-10 is a back view of the locking mechanism in the key release position;

FIG. 2-11 is a back view of the locking mechanism in the combination lock release position;

FIG. 2-12 is a back view of the locking mechanism in the emergency paddle release position;

FIG. 2-13 is a back view of the locking mechanism in the key enabled combination change position;

FIG. 3-1 is an isometric front view of the lock assembly;

FIG. 3-2 is an isometric rear view of the lock assembly;

FIG. 3-3 is an exploded view of the locking mechanism;

FIG. 3-4 is an isometric view of the basic lock components;

FIG. 3-5 is an isometric view of the completed assembly, cover removed;

FIG. 3-6 is a left view of the locking mechanism;

FIG. 3-7 is a bottom view of the locking mechanism;

FIG. 3-8 is a back view of the locking mechanism in the unlocked position;

FIG. 3-9 is a back view of the locking mechanism in the locked position;

FIG. 3-10 is a back view of the locking mechanism in the key release position;

FIG. 3-11 is a back view of the locking mechanism in the combination lock release position;

FIG. 3-12 is a back view of the locking mechanism in the emergency paddle release position;

FIG. 3-13 is a back view of the locking mechanism in the key enabled combination change position.

DETAILED DESCRIPTION OF THE INVENTION

Figure 1:
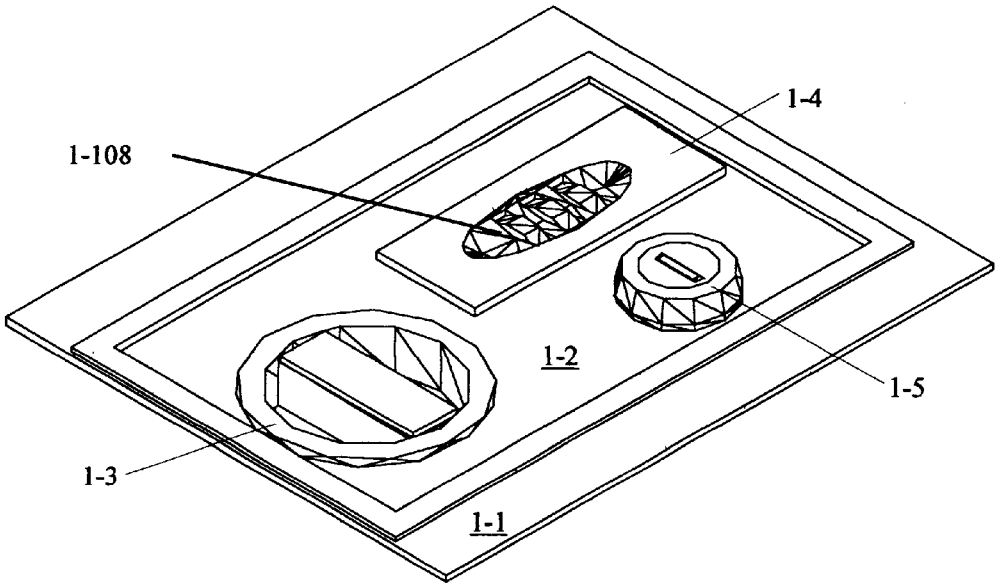
FIG. 1-1 is an isometric front view of the lock assembly.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Before the present methods and embodiments for making a two-party delivery using a lockable receptacle are disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

It must be noted that, as used in this specification and the appended claims, the singular forms "a," "an," and "the" include plural referents unless the context clearly dictates otherwise.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps.

The figures illustrate at least three different embodiments of the invention, series 1 of the figures disclosing the first embodiment, series 2 of the figures disclosing the second embodiment, and series 3 of the figures disclosing the third embodiment. Like structures will usually be designated with like references numerals, for example, item 1-7 illustrates a locking lever in series 1 of the figures, while the same structural item is shown as item 2-7 in series 2 of the figures, and as item 3-7 in series 3 of the figures. Exceptions to this convention include item 1-53 in series 1 of the figures, which corresponds exactly to item 2-60 and 3-60 in series 2 and 3 of the figures, even though the suffix-numeral "60" was chosen for use in the series 2 and series 3 versions of that item. Item 1-41 corresponds to items 2-44 and 3-44. Item 1-54 corresponds to items 2-61 and 3-61.

This locking mechanism is comprised of three parts, a rotary latch, a three-digit combination lock assembly (using one of three different variations of the lock), and a key lock assembly.

Configuration with Three Digit Top Release, Back Change Combination Lock

FIGS. 1-1 Through 1-16

FIG. 1-1 shows a perspective front view of the locking mechanism, designated generally at 1-122. The locking mechanism is inserted through a rectangular hole in door 1-1, and catches the raised lip of the bezel 1-2 to hold the mechanism from shifting vertically or horizontally. The rotary latch 1-3 is mounted through a hole in a bezel plate 1-2, and secured by a mounting strap and a nut provided with the lock. The combination lock 1-4 is mounted to the bezel 1-2 with connector pieces 1-34 and 1-35 through the rear cover. The combination lock 1-4 includes moveable combination digits 1-108 as known to those of ordinary skill in the art. The connector pieces 1-34 and 1-35 may, for example, comprise screws. The key lock 1-5 is inserted through a hole in the bezel 1-2 and secured with a locking nut provided with the lock.

Figures 1, 2:
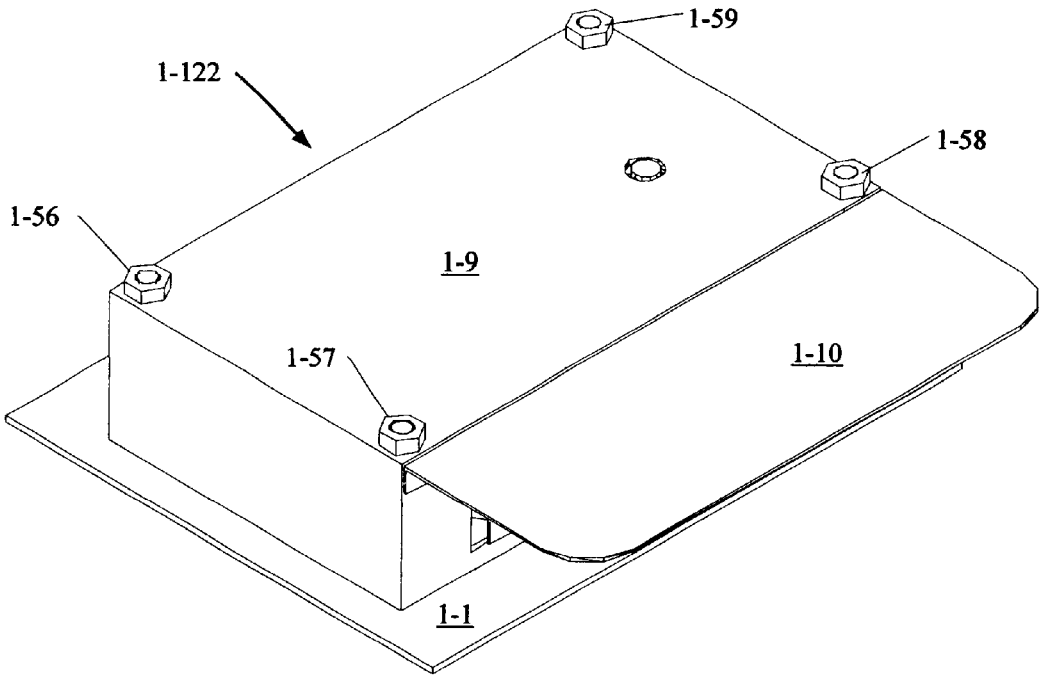

FIG. 1-2 shows the rear of the locking mechanism fully assembled with the cover installed. Nuts 1-56 through 1-59 hold the lock assembly in place by pulling the bezel 1-2 through a rectangular hole in door 1-1 and pushing the cover 1-9 against the back side of the door 1-1. The emergency release paddle 1-10 is also shown in this figure.

Figures 1, 2, 3:
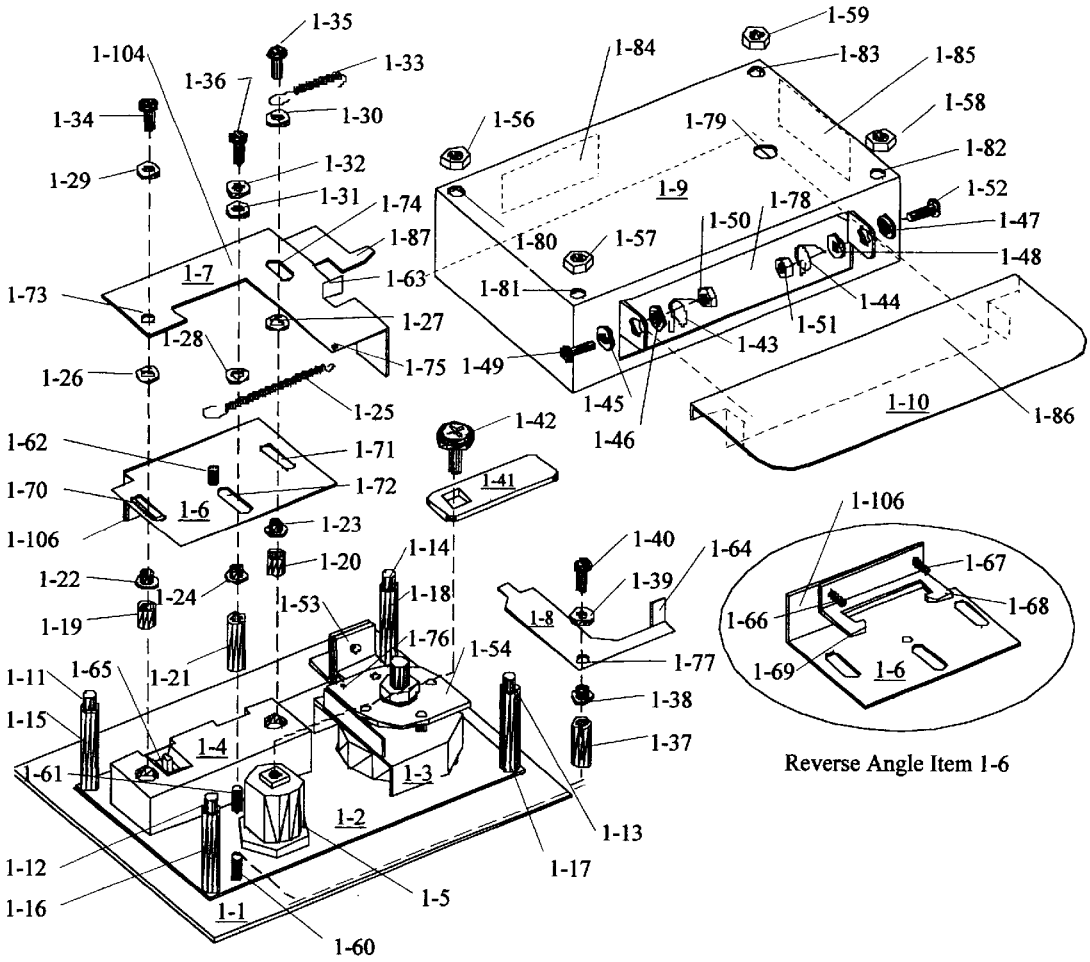

FIG. 1-3 shows an exploded view of the locking mechanism with the linkages that connect the locking components into the complete mechanism. FIG. 1-3 also depicts the assembly of the locking mechanism.

The combination interlock lever 1-6 comprises a main body as shown and includes a ledge 1-106 extending outwardly from the main body, for example in a substantially orthogonal arrangement. The interlock lever 1-6 is mounted on top of spacers 1-19 and 1-20, which rest in mounting holes in the back cover of the combination lock 1-4. Threaded spacer 1-21 screws onto stud 1-61. Shoulder washers 1-22, 1-23, and 1-24 positioned above spacers 1-19, 1-20, and 1-21 have shoulders, which extend through the combination interlock lever holes 1-70, 1-71, and 1-72 and provide support and guide the travel between the locked and unlocked positions for the combination interlock lever. More specifically, the locking lever 1-7, and locking stud 1-102, and lock latch lever 1-53, sometimes referred to herein as a locking member, are all shown in FIG. 1-9 in a locked position, and in FIG. 1-8 in an unlocked position. It is to be understood that the chamfered engagement foot 1-87 and locking lever 1-7 are caused to move upwardly out of engagement with a locking stud 1-102 into an unlocked position, after which movement of the locking stud 1-102 permits a downward return movement of the locking lever 1-7 while still in an unlocked position in that lock latch lever 1-53 remains in its upward unlocked position at this described condition. The chamfered foot 1-87 may, for example, include a chamfered edge 1-124 that extends toward the locking stud 1-102 when said locking stud 1-102 is in the locked position. The chamfered engagement foot 1-87 may, for example, narrow in width in a lateral direction.

Washers 1-28, 1-31, and 1-32 are placed over the shoulder of shoulder washer 1-24 and a screw 1-36 is then screwed into threaded spacer 1-21. In FIG. 1-3 "Reverse Angle Item 1-6" you can see springs 1-66 and 1-67, and engagement tabs 1-68 and 1-69, which are held by combination lock 1-4 in the locked position. When the combination interlock lever 1-6 is held in the down position by depressing the top of interlock lever 1-6 with your finger through hole 1-84 in cover 1-9, this compresses springs 1-66 and 1-67. A holding bar 1-100 is placed between the opening made by the engagement tabs 1-68 and 1-69 (see FIG. 1-14 through 1-16) such that rotating the three combination digits 1-108 from the correct combination of symbols causes the holding bar 1-100 to be secured into the locked position (as shown in FIGS. 1-14 and 1-15) in interlocking engagement with the engagement tabs 1-68 and 1-69 within the combination lock 1-4, thereby holding interlock lever 1-6 in a locked or compressed or down position as shown in FIG. 1-14. More specifically, the holding bar 1-100 includes first and second engagement edges 1-110 and 1-112 that reside in engagement with the engagement tabs 1-68 and 1-69, respectively, when the locking lever 1-7 resides in the locked position as shown most clearly in FIG. 1-9. The holding bar 1-100 includes a main body as shown in FIG. 1-14. The engagement edges 1-110 and 1-112 may, for example, be narrower than the main body of the holding bar 1-100. For example, the engagement edges 1-110 and 1-112 may each have a width that is less than one-fourth of a width of the main body of the holding bar 1-100.

It will be appreciated by one of ordinary skill in the art that the correct combination is the predetermined code that may be changed from time to time, and releases the holding bar 1-100 by aligning the locking wheels such that the holding bar 1-100 may be released. When the combination digits 1-108 are moved to achieve the correct combination of symbols, an internal mechanism (not shown) operates as known to those of ordinary skill to impart movement to the holding bar 1-100 to thereby release said holding bar 1-100 from engagement with the engagement tabs 1-68 and 1-69 by causing said holding bar 1-100 to rotate about a vertical axis. The internal mechanism (not shown) is also referred to herein as a moving means. When the holding bar 1-100 is released (FIG. 1-16), by inputting the correct combination of readable combination symbols, the combination lock 1-4 releases tabs 1-68 and 1-69 and springs 1-66 and 1-67 are released from their compressed condition to thereby push the combination interlock lever 1-6 upwardly, or into the unlocked position, also referred to as a pushing means. It will be appreciated by one of ordinary skill in the art that readable combination symbols may be numbers, letters, characters or any combination thereof. The stud 1-62 on combination interlock lever 1-6 then engages the locking lever 1-7 pushing it up, into the disengaged position. FIG. 1-11 depicts the release of the lock by combination interlock lever 1-6.

On locking lever 1-7, chamfered engagement foot 1-87 interlocks with locking stud 1-102 and stud plate 1-54, which engages the rotary lock latch lever 1-53. When in the locked position (see FIG. 1-9) chamfered engagement foot 1-87 keeps the stud plate 1-54, which is under spring tension via spring 1-33, from rotating counter clockwise to the unlocked position, the action of getting into the locked position is also referred to as a latching means. Locking lever 1-7 is held in place by washers 1-26 and 1-27, which are placed over the shoulder of the shoulder washers 1-22 and 1-23 to act as spacers between levers 1-6 and 1-7. Locking lever 1-7 is then placed over shoulder washers 1-22 and 1-23 shoulders through holes 1-73 and 1-74 in lever 1-7. Washers 1-29 and 1-30 are then placed over the shoulders of shoulder washers 1-22 and 1-23, and then secured by screws 1-34 and 1-35. Spring 1-25 holds locking lever 1-7 in the locked position unless released by the combination locking lever 1-6 through stud 1-62, the cam lock lever 1-41, or the emergency release paddle 1-10 through tab 1-86. As the locking lever 1-7 becomes disengaged from the locked position, the locking stud 1-102 on stud plate 1-54 rotates under chamfered engagement foot 1-87 of the locking lever 1-7. The stud plate 1-54 engages the rotary lock latch lever 1-53 and rotates counter clockwise to the released position (see FIG. 1-8).

Cam lock lever 1-41 is held in place by screw 1-42, which screws into lock 1-5. When the key is inserted into lock 1-5, also referred to as a key receiving means, and rotated in the counter clockwise direction, cam lock lever 1-41 engages cam tab 1-63 on locking lever 1-7 and pushes it up, into the disengaged position. FIG. 1-10 depicts the release of the lock by cam lock lever 1-41.

The locking lever 1-7 includes a main body 1-104, and a cam tab 1-63 extending outwardly from said main body 1-104, and a chamfered engagement foot 1-87 extending from said main body 1-104. The main body 1-104 may, for example, comprise an L-shaped portion as shown, having an opening 1-74 formed therein for receiving a screw or connector piece 1-35 therethrough.

The emergency release paddle 1-10 is mounted with shoulder washers 1-45, 1-46, 1-47, and 1-48. Springs 1-43 and 1-44 hold the paddle 1-10 up, or disengaged position. Screws 1-49 and 1-52 and nuts 1-50 and 1-51 secure the emergency release paddle 1-10 to the cover 1-9. The above description is also referred to as being pivotally mounted. When the emergency release paddle 1-10 is pushed, it pivots around the shoulder washers 1-45 through 1-49 and tab 1-86 engages the locking lever 1-7 pushing it up, into the disengaged position. FIG. 1-12 depicts the release of the lock by the emergency release paddle 1-10.

The combination lock's code can be changed only with the use of the key lock 1-5. With the combination lock code set to the present, correct code, the cam lock lever 1-41, can be rotated clockwise until it contacts code change lever 1-8, which then will rotate around shoulder washer 1-38, positioned on top of threaded spacer 1-37, which is screwed onto stud 1-60. Shoulder washer 1-38 extends through hole 1-77 in the code change lever 1-8 and washer 1-39 and is secured by screw 1-40. The code change lever 1-8 then engages the slide lever 1-65 on the back of the combination lock 1-4. With the slide lever 1-65 engaged, the combination can be changed to any desired three digit number combination by rotating the numbered wheels on the front of the combination lock 1-4 (see FIG. 1-1). FIG. 1-13 depicts the engagement of levers 1-41, 1-8, and 1-65, which allows the change of combination code. When the key lock 1-5 is released, and rotated back to the normal position, the slide lever 1-65 is thereby released and the new combination is enabled.

FIG. 1-4 shows an isometric view of the basic purchased components and their respective positions on the bezel 1-2.

FIG. 1-5 shows an isometric view of the complete assembly with the cover 1-9 and emergency release paddle 1-10 removed. Item numbers are called out to assist in the understanding of the locking mechanism assembly.

FIGS. 1-6 and 1-7 show side views of the locking mechanism for ease of understanding the relationship between the levers and other components.

FIGS. 1-17 and 1-19 illustrate the receptacle 1-120 having the hinged door 1-1 on which the locking mechanism 1-122 is mounted. Also shown in those figures is the existence of a portion of the receptacle 1-120 referred to hereinto as the engagement lip 1-114. The lock latch lever 1-53 is blocked by the engagement lip 1-122 when the lock latch lever 1-53 resides in the locked position shown in FIG. 1-9. The blocked condition is also referred to herein as an interference fit.

The phrase "interference fit" as used herein shall refer broadly to the concept of a blocking relationship between two members in which a portion of one member abuts or resides in alignment with some portion of the other member, in a manner that contactibly blocks the movement of one member with respect to the other member in at least a first direction. In this case, the engagement lip 1-114 and the lock latch lever 1-53 reside in an interference fit when the lock latch lever is in the locked position shown in FIG. 1-9, because the engagement lip 1-114 resides in alignment with the lock latch lever 1-53 and thereby contactibly blocks movement of the latch member 1-53 to inhibit opening of the door 1-1 as seen by inspection of the FIGS. 1-9 and 1-17 in combination.

Configuration with Three Digit Back Release, Front Change Combination Lock

FIGS. 2-1 Through 2-13

FIG. 2-1 shows a perspective front view of the locking mechanism. The locking mechanism is inserted through a rectangular hole in door 2-1, and engages the raised lip of bezel 2-2 to hold the mechanism from shifting vertically or horizontally. The rotary latch 2-3 is mounted through a hole in a bezel plate 2-2, and secured by a mounting strap and a nut provided with the lock. The combination lock 2-4 is mounted to the bezel 2-2 using studs 2-88 through 2-91 and threaded spacers 2-19, 2-20, 2-35, and 2-36 (see FIG. 2-3), and includes moveable combination digits as shown. The combination lock is engaged by sliding the thumb slide 2-92 to the right after inputting the correct three digit code. The key lock 2-5 is inserted through a hole in the bezel 2-2 and secured with a locking nut provided with the lock.

FIG. 2-2 shows an isometric rear view of the locking mechanism fully assembled with the cover installed. Nuts 2-56 through 2-59 hold the lock assembly in place by pulling the bezel 2-2 through a rectangular hole in door 2-1 and pushing cover 2-9 against the back side of the door 2-1. The emergency release paddle 2-10 is also shown in this figure.

FIG. 2-3 shows an exploded view of the locking mechanism with the linkages that connect the locking components into the complete mechanism.

FIG. 2-3 also depicts the assembly of the locking mechanism as follows:

The support bracket 2-6 is mounted through holes 2-76 and 2-78 with screws 2-21 and 2-22 into threaded spacers 2-19 and 2-20, which are screwed onto studs 2-88 and 2-89. Locking lever 2-7 is supported and pivots around shoulder washer 2-24. Shoulder washer 2-24 is positioned on top of spacer 2-23, which is positioned on top of support bracket 2-6. The shoulder of washer 2-24 extends through washer 2-25, then through hole 2-70 in bracket 2-7, and through washer 2-30. Screw 2-33 then secures the assembly by screwing into the tapped hole 2-77 in support bracket 2-6. Threaded standoff 2-27 screws into the combination lock 2-4. Screw 2-34 through the end of spring 2-32, washer 2-31, hole 2-71 in locking lever 2-7, then through washer 2-29, and shoulder washer 2-28, screws into the top of threaded spacer 2-27. Washers 2-31 and 2-29 with shoulder washer 2-24 through them act as a guide and support assembly for bracket 2-7 as it pivots rotationally around a washer 2-24 in hole 2-70. When the three digit combination is dialed correctly, the thumb slide 2-92 on the front of the lock mechanism, can be pushed to the right. This in turn pushes threaded standoff 2-27 with shoulder washer 2-28, washer 2-29 and 2-31, and screw 2-34 to the left. This action in the slotted hole 2-71 of locking lever 2-7 forces the lever up into the disengaged position. FIG. 2-11 depicts the release of the lock with the three digit combination lock.

On locking lever 2-7, chamfered engagement foot 2-87 interlocks with rotary latch 2-3, stud plate 2-61, which engages the rotary lock latch lever 2-60. When in the locked position (see FIG. 2-9), chamfered engagement foot 2-87 keeps stud plate 2-61 which is under spring tension via spring 2-32, from rotating counter clockwise to the unlocked position. Spring 2-26 holds locking lever 2-7 in the locked position unless released by the combination lock stud assembly through hole 2-71, the cam lock lever 2-44, or the emergency release paddle 2-10 through tab 2-86. When the locking lever 2-7 is held in the disengaged position, the locking stud 2-102 on stud plate 2-61 rotates under chamfered engagement foot 2-87 of the locking lever 2-7. The stud plate 2-61 engages the rotary lock latch lever 2-60, and rotates counter clockwise to the released position (see FIG. 2-8).

Cam lock lever 2-44 is held in place by screw 2-45 which screws into lock 2-5. When the key is inserted into lock 2-5 and rotated in the counter clockwise direction (as viewed from the back), cam lock lever 2-44 engages cam tab 2-63 on locking lever 2-7 and pushes it up, into the disengaged position. FIG. 2-10 depicts the release of the lock by cam lock lever 2-44.

The emergency release paddle 2-10 is mounted with shoulder washers 2-48, 2-49, 2-50, and 2-51. Springs 2-46 and 2-47 hold the paddle 2-10 in the up, or disengaged position. Screws 2-52 and 2-55 and nuts 2-53 and 2-54 secure the emergency release paddle 2-10 to cover 2-9. When the emergency release paddle 2-10 is pushed it pivots around the shoulder washers 2-48 through 2-51 and tab 2-86 engages locking lever 2-7 pushing it up, into the disengaged position. FIG. 2-12 depicts the release of the lock by the emergency release paddle 2-10.

The combination lock's code can be changed only with the use of the key lock 2-5. With the combination lock code set to the present, correct code, the cam lock lever 2-44, can be rotated clockwise (as viewed from the back) until it contacts the code change lever 2-8, and tab 2-64. With cam lock lever 2-44 engaged with tab 2-64 of code change lever 2-8, lever 2-8 will slide to the down or extended position via slots 2-73 and 2-74. In this position the combination lock thumb slide 2-92 can be pushed to the left, and engagement assembly, parts 2-27, 2-28, 2-29, 2-31, and 2-34, movement is allowed due to the indent in the code change lever 2-8. When the cam lock lever 2-44 is returned to the normal position, spring 2-41 returns the code change lever 2-8 to the original position which inhibits movement of the thumb slide 2-92 to the left, which enables the combination code change to be made. The code change lever 2-8 is supported and guided by shoulder washers 2-37 and 2-38, which are positioned on top of threaded spacers 2-35 and 2-36. The shoulder of shoulder washer 2-37 extends through hole 2-73 in code change lever 2-8 and then through washer 2-39, the end of spring 2-41, and is secured by screw 2-42 which threads into threaded spacer 2-35. The shoulder of shoulder washer 2-38 extends through hole 2-74 in code change lever 2-8 and then through washer 2-40, and is secured by screw 2-43, which threads into threaded spacer 2-36. FIG. 2-13 depicts the engagement of the lever required to change the code of the combination lock.

Figures 1, 2, 3, 4:
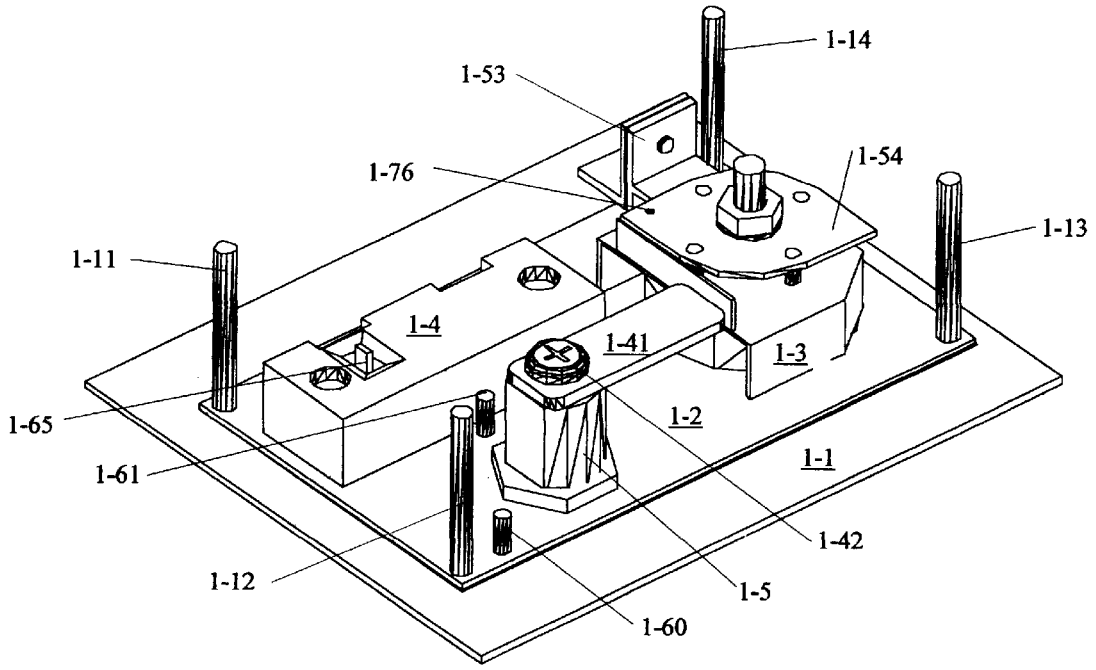

FIG. 2-4 shows an isometric view of the basic purchased components and their respective positions on the bezel 2-2.

FIG. 2-5 shows an isometric view of the complete assembly with the cover 2-9 and emergency release paddle 2-10 removed. Item numbers are called out to assist in the understanding of the locking mechanism assembly.

FIGS. 2-6 and 2-7 show side views of the locking mechanism for ease of understanding the relationship between the levers and other components.

Configuration with Three Digit Back Release, Back Change Combination Lock

FIGS. 3-1 Through 3-13

FIG. 3-1 shows a perspective front view of the locking mechanism. The locking mechanism is inserted through a rectangular hole in door 3-1, and engages the raised lip of bezel 3-2 to hold the mechanism from shifting vertically or horizontally. The rotary latch 3-3 is mounted through a hole in a bezel plate 3-2, and secured by a mounting strap and a nut provided with the lock. The combination lock 3-4 is mounted to the bezel 3-2 using studs 3-88 through 3-91 and threaded spacers 3-19 and 3-20, and nuts 3-66 and 3-67 (see FIG. 3-3), and including moveable combination digits as shown. The combination lock 3-4 is engaged by sliding thumb slide 3-92 to the right after inputting the correct three digit code. Key lock 3-5 is inserted through a hole in the bezel 3-2 and secured with a locking nut provided with the lock.

FIG. 3-2 shows an isometric rear view of the locking mechanism fully assembled with the cover installed. Nuts 3-56 through 3-59 hold the lock assembly in place by pulling the bezel 3-2 through a rectangular hole in door 3-1 and pushing cover 3-9 against the back side of the door 3-1. The emergency release paddle 3-10 is also shown in this figure.

FIG. 3-3 shows an exploded view of the locking mechanism with the linkages that connect the locking components into the complete mechanism.

FIG. 3-3 also depicts the assembly of the locking mechanism as follows:

Support bracket 3-6 is mounted by screw 3-25 through hole 3-76 into threaded spacer 3-19, and screw 3-26 through hole 3-78, washers 3-23 and 3-24, through hole 3-73 of the code change lever 3-8, washer 3-22, and through shoulder washer 3-21 into threaded spacer 3-20. Threaded spacers 3-19 and 3-20 are screwed onto studs 3-88 and 3-89. Locking lever 3-7 is supported and pivots around shoulder washer 3-28. Shoulder washer 3-28 is positioned on top of spacer 3-27, which is positioned on top of support bracket 3-6. The shoulder of washer 3-28 extends through washer 3-29, through hole 3-70 in bracket 3-7, and then through washer 3-35. Screw 3-37 then secures the assembly by screwing into the tapped hole 3-77 in support bracket 3-6. Threaded standoff 3-30 screws into combination lock 3-4. Screw 3-38 through the end of spring 3-34, washer 3-36, hole 3-71 in locking lever 3-7, then through washer 3-32, and shoulder washer 3-31, screws into the top of threaded spacer 3-30. Washers 3-36 and 3-32 with shoulder washer 3-31 through them act as a guide and support assembly for bracket 3-7 as it pivots rotationally around washer 3-28 in hole 3-70. When the three digit combination is dialed correctly, the thumb slide 3-92 on the front of the lock mechanism can be pushed to the right. This in turn pushes the combination engagement assembly, threaded standoff 3-30 with shoulder washer 3-31, washer 3-32, 3-36, and screw 3-38 to the left. This action in the slotted hole 3-71 of locking lever 3-7 forces the lever up into the disengaged position. FIG. 3-11 depicts the release of the lock with the three digit combination lock.

On locking lever 3-7, chamfered engagement foot 3-87 interlocks with rotary latch 3-3, stud plate 3-61, which engages the rotary lock latch lever 3-60. When in the locked position (see FIG. 3-9), chamfered engagement foot 3-87 keeps stud plate 3-61 which is under spring tension via spring 3-34, from rotating counter clockwise to the unlocked position. Spring 3-33 holds locking lever 3-7 in the locked position unless released by the combination lock stud assembly through hole 3-71, the cam lock lever 3-44, or the emergency release paddle 3-10 through tab 3-86. When the locking lever 3-7 is held in the disengaged position, the locking stud 3-102 on stud plate 3-61 rotates under chamfered engagement foot 3-87 of locking lever 3-7. Stud plate 3-61 engages the rotary lock latch lever 3-60, rotates counter clockwise to the released position (see FIG. 3-8).

Cam lock lever 3-44 is held in place by screw 3-45 which screws into lock 3-5. When the key is inserted into the lock 3-5 and rotated in the counter clockwise direction (as viewed from the back), cam lock lever 3-44 engages cam tab 3-63 on locking lever 3-7 and pushes it up, into the disengaged position. FIG. 3-10 depicts the release of the lock by cam lock lever 3-44.

The emergency release paddle 3-10 is mounted with shoulder washers 3-48, 3-49 3-50, and 3-51. Springs 3-46 and 3-47 hold the paddle 3-10 in the up, or disengaged position. Screws 3-52 and 3-55 and nuts 3-53 and 3-54 secure the emergency release paddle 3-10 to the cover 3-9. When the emergency release paddle 3-10 is pushed it pivots around the shoulder washers 3-48 through 3-51 and tab 3-86 engages locking lever 3-7 pushing it up, into the disengaged position. FIG. 3-12 depicts the release of the lock by the emergency release paddle 3-10.

The combination lock's code can be changed only with the use of the key lock 3-5. With the combination lock code set to the correct code and the key inserted into the key lock, the cam lock lever 3-44, can be rotated clockwise (as viewed from the back) until it contacts code change lever 3-8, tab 3-64. With cam lock lever 3-44 engaged with tab 3-64 of code change lever 3-8, lever 3-8 will rotate around washer 3-40 through hole 3-74 in the code change lever 3-8. This causes code change lever 3-8 to engage lever 3-65 on the back of the combination lock 3-4, and move lever 3-65 to the right, in this position the combination code can be changed. The code change lever 3-8 is held in place and rotates around washer 3-40, which is positioned on top of threaded spacer 3-39, which is screwed onto stud 3-62. The shoulder of shoulder washer 3-40 extends through washer 3-41 hole 3-74 of code change lever 3-8 through washer 3-42 and is secured by screw 3-43 which is screwed into threaded spacer 3-39. Code change lever 3-8 is guided and supported at the top by washers 3-22 and 3-23, with shoulder washer 3-21 through them. FIG. 3-13 depicts the engagement of the levers required to change the code of the combination lock.

FIG. 3-4 shows an isometric view of the basic purchased components and their respective positions on the bezel 3-2.

Figures 1, 2, 3, 4, 5:
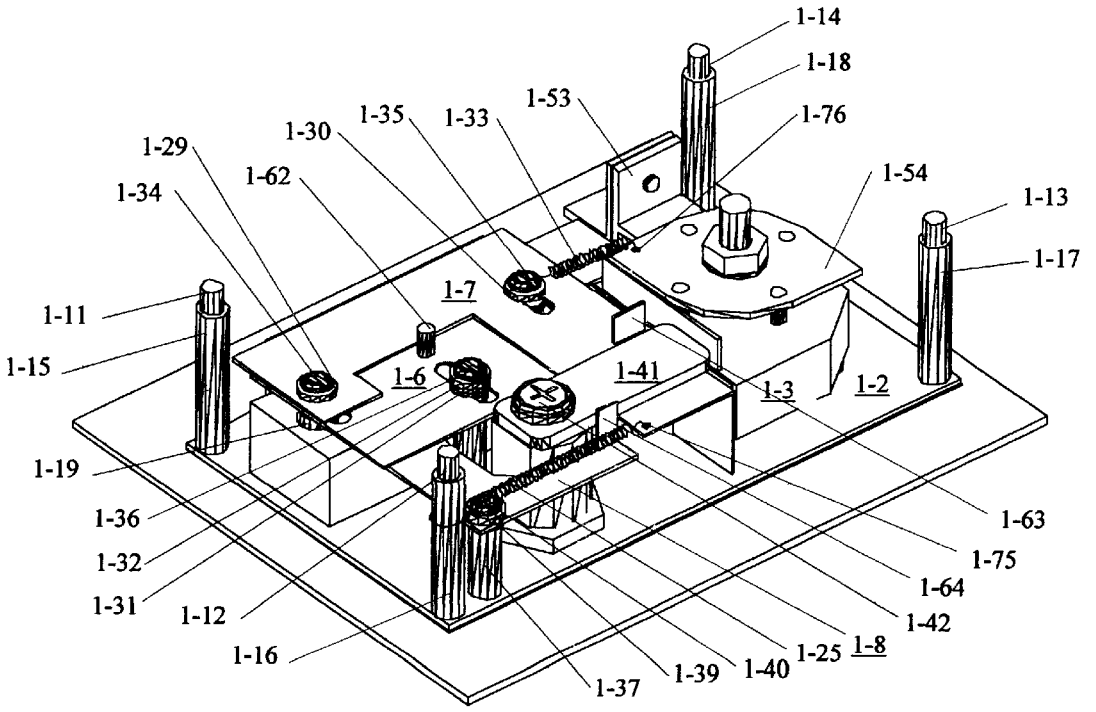
Figures 1, 2, 3, 4, 5, 6:
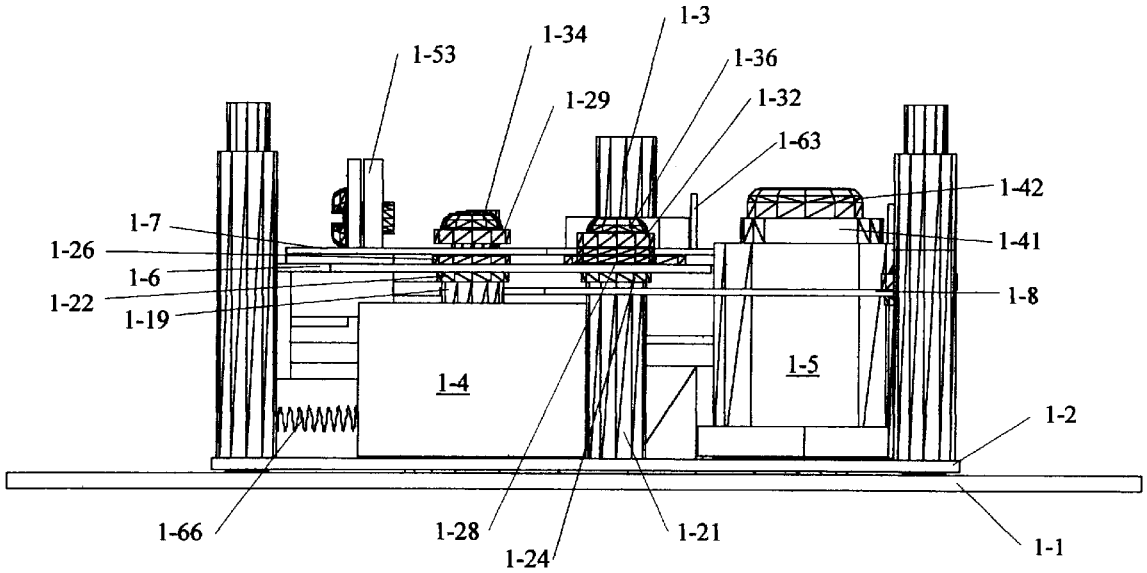
Figures 1, 2, 3, 4, 5, 6, 7:
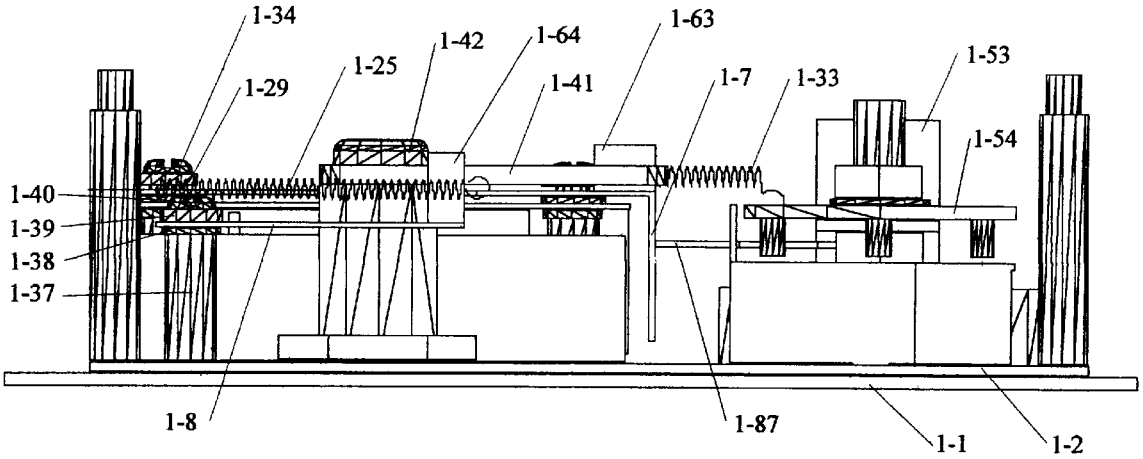
Figures 1, 2, 3, 4, 5, 6, 7, 8:
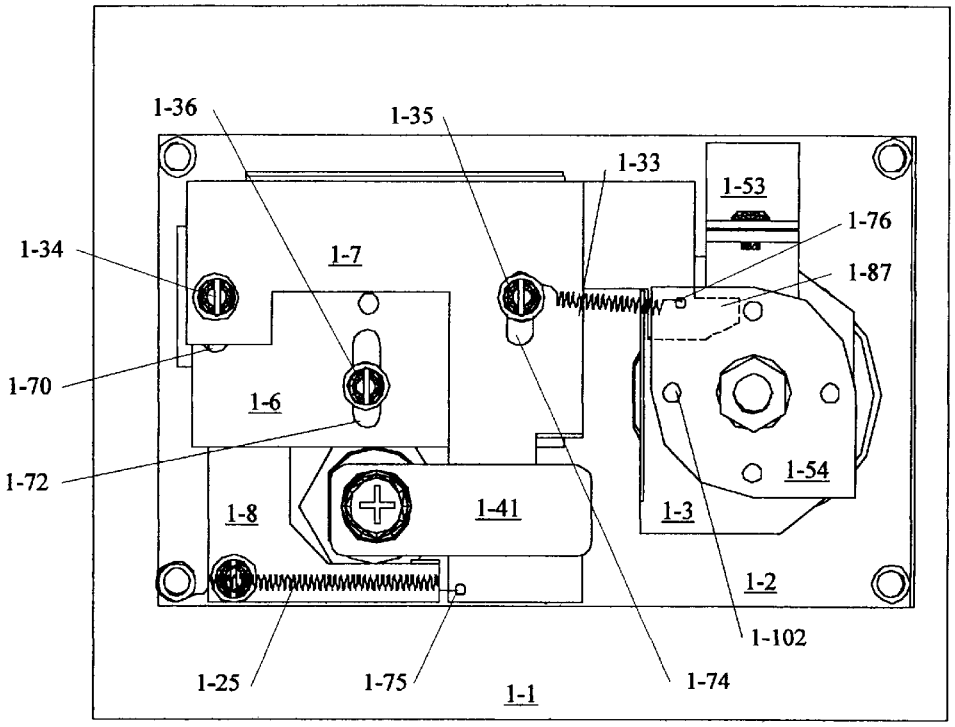
Figures 1, 2, 3, 4, 5, 6, 7, 8, 9:
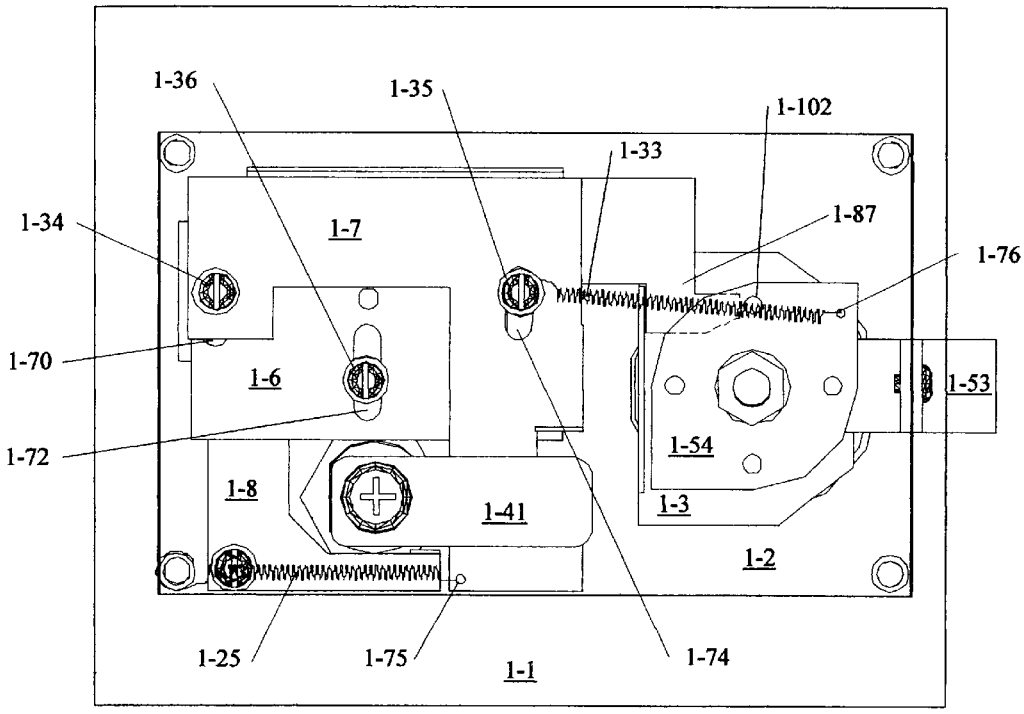
Figures 1, 2, 3, 4, 5, 6, 7, 8, 9, 10:
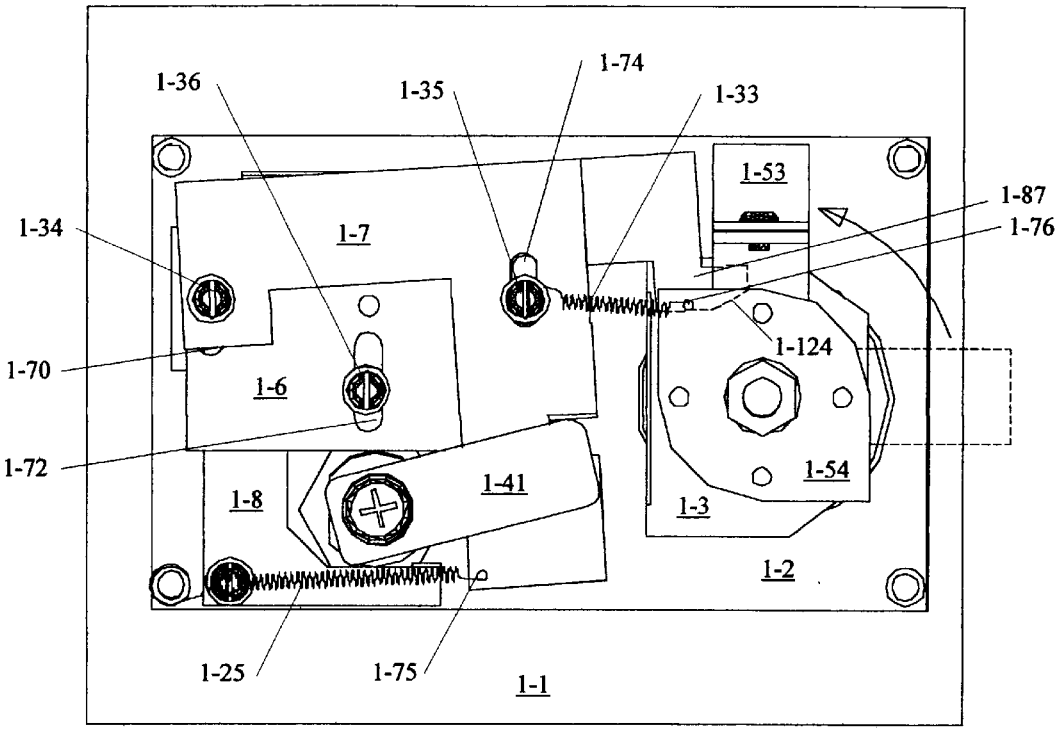
Figures 1, 2, 3, 4, 5, 6, 7, 8, 9, 10, 11:
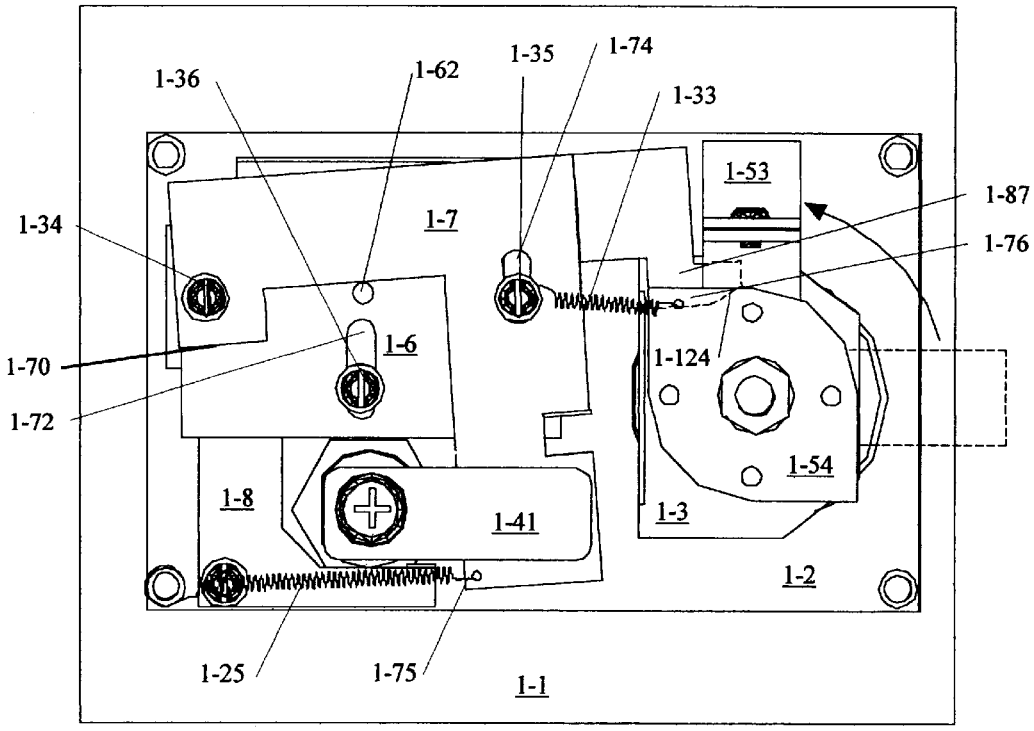
Figures 1, 2, 3, 4, 5, 6, 7, 8, 9, 10, 11, 12:
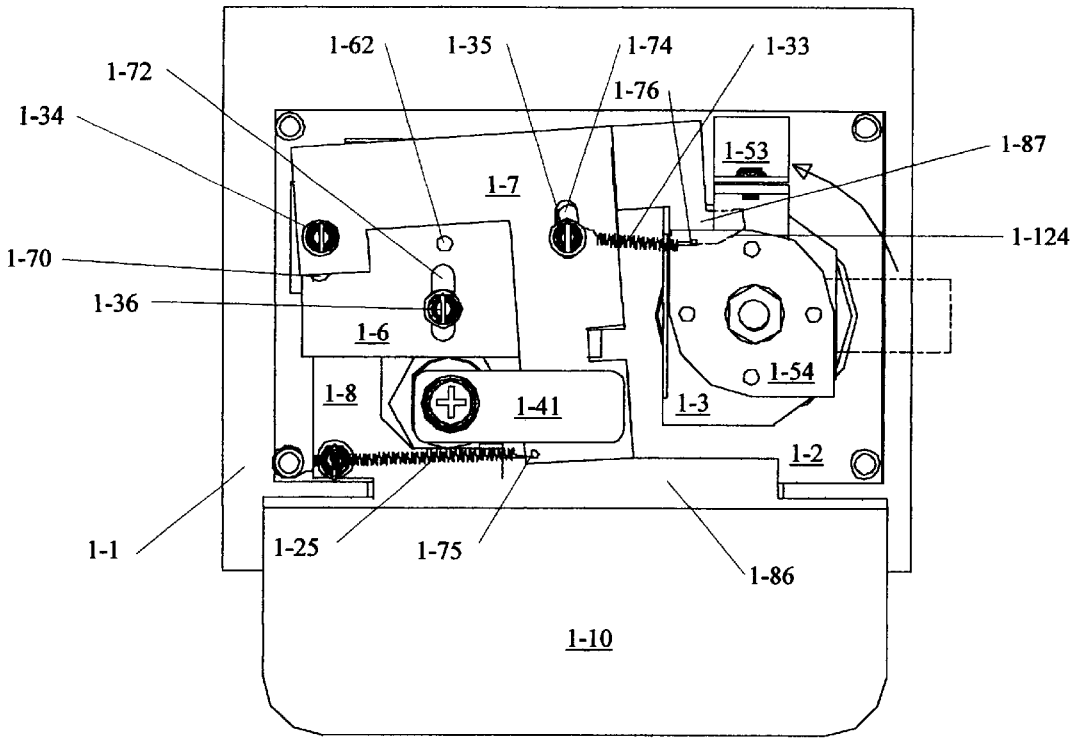
Figures 1, 2, 3, 4, 5, 6, 7, 8, 9, 10, 11, 12, 13:
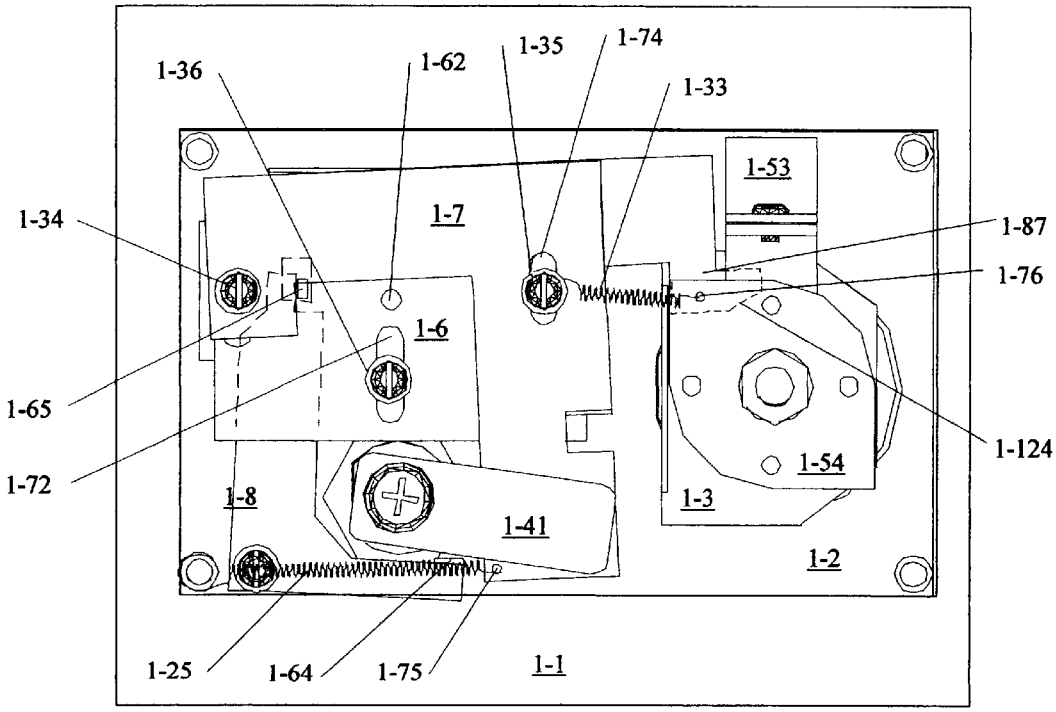
Figures 1, 2, 3, 4, 5, 6, 7, 8, 9, 10, 11, 12, 13, 14:
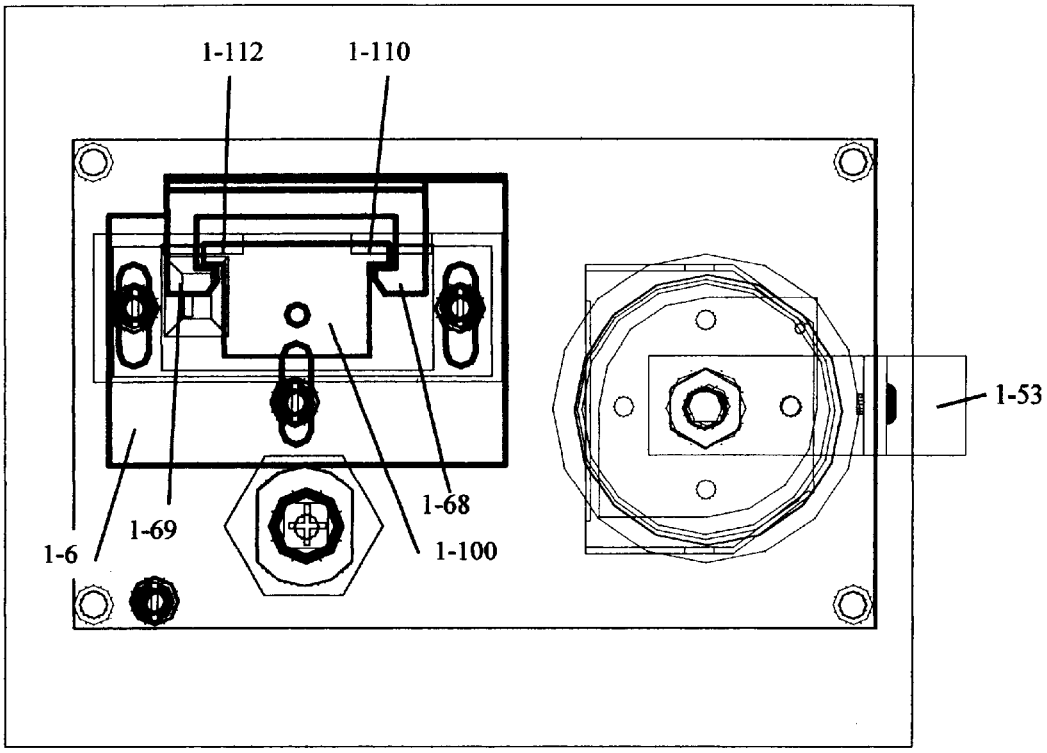
Figures 1, 2, 3, 4, 5, 6, 7, 8, 9, 10, 11, 12, 13, 14, 15:
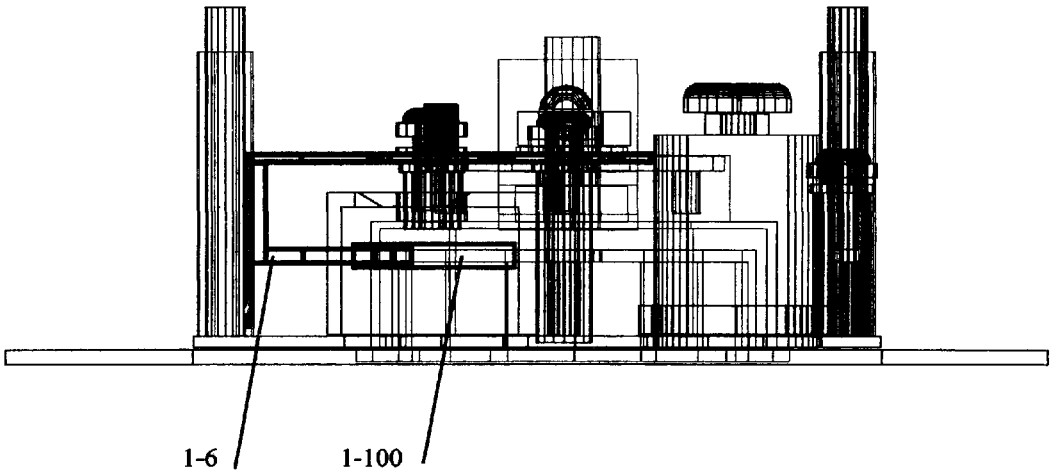
Figures 1, 2, 3, 4, 5, 6, 7, 8, 9, 10, 11, 12, 13, 14, 15, 16:
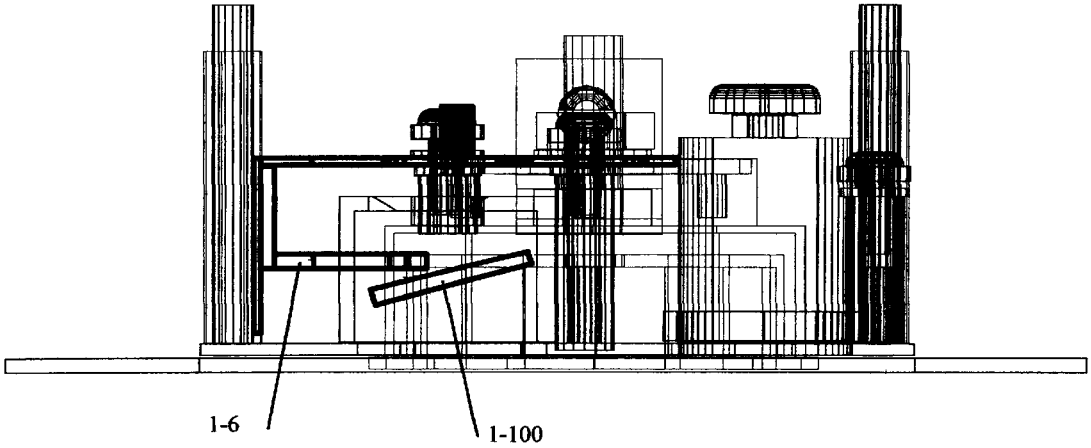
Figures 1, 2, 3, 4, 5, 6, 7, 8, 9, 10, 11, 12, 13, 14, 15, 16, 17:
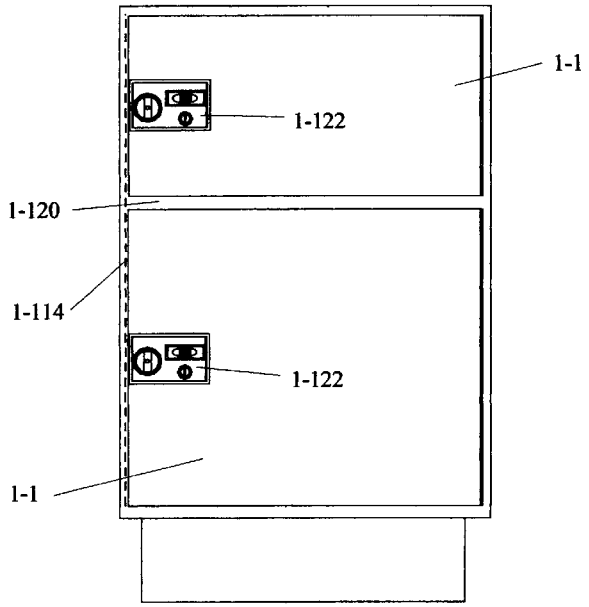
Figures 1, 2, 3, 4, 5, 6, 7, 8, 9, 10, 11, 12, 13, 14, 15, 16, 17, 18:
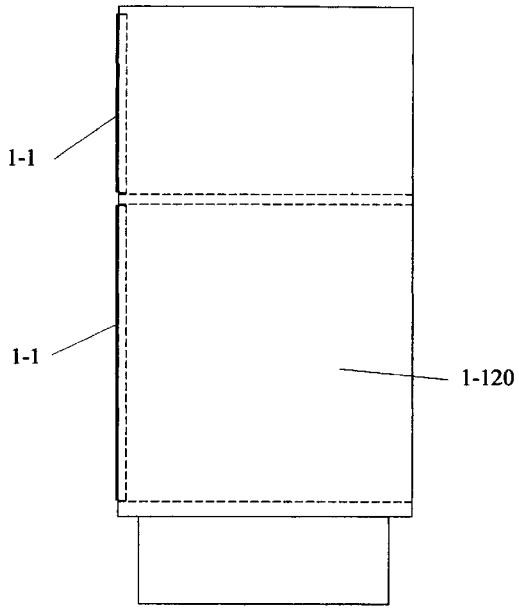
Figures 1, 2, 3, 4, 5, 6, 7, 8, 9, 10, 11, 12, 13, 14, 15, 16, 17, 18, 19:
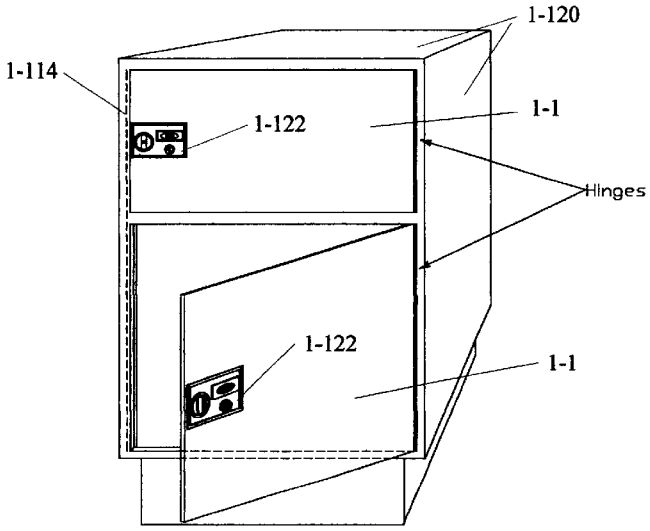
Figures 1, 2:
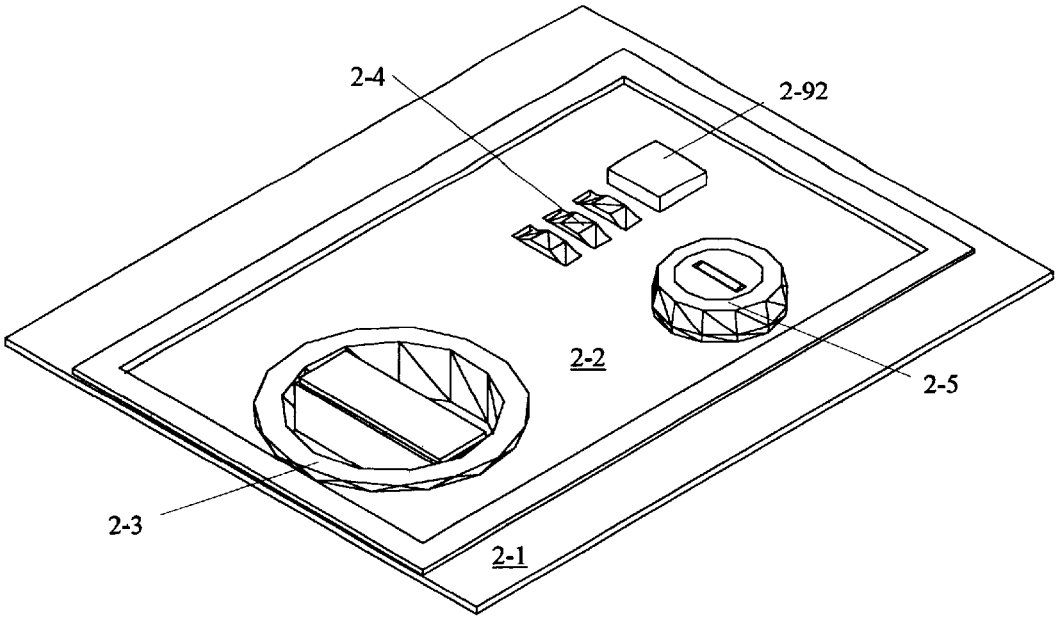
Figure 2:
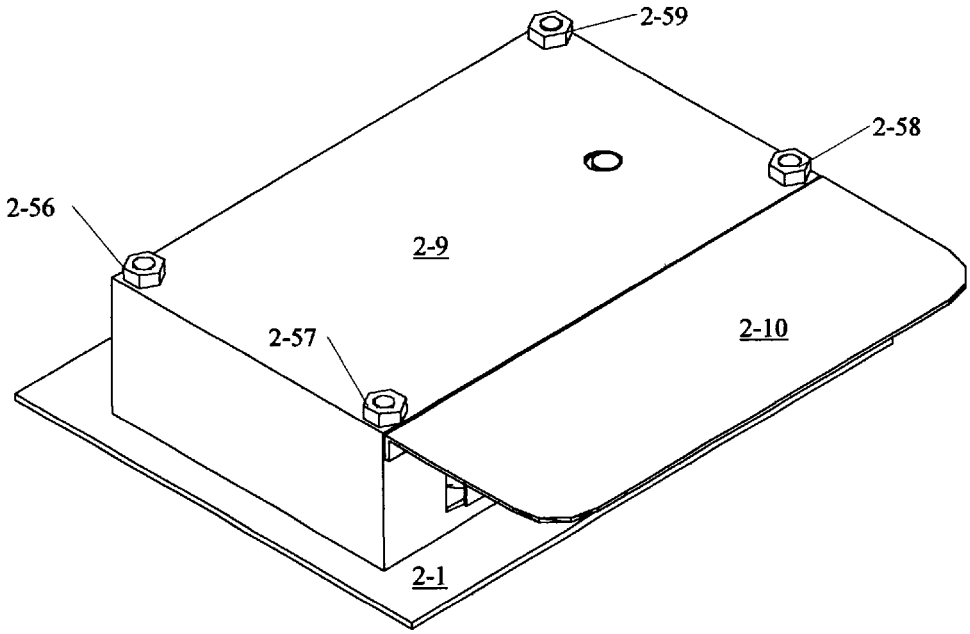
Figures 2, 3:
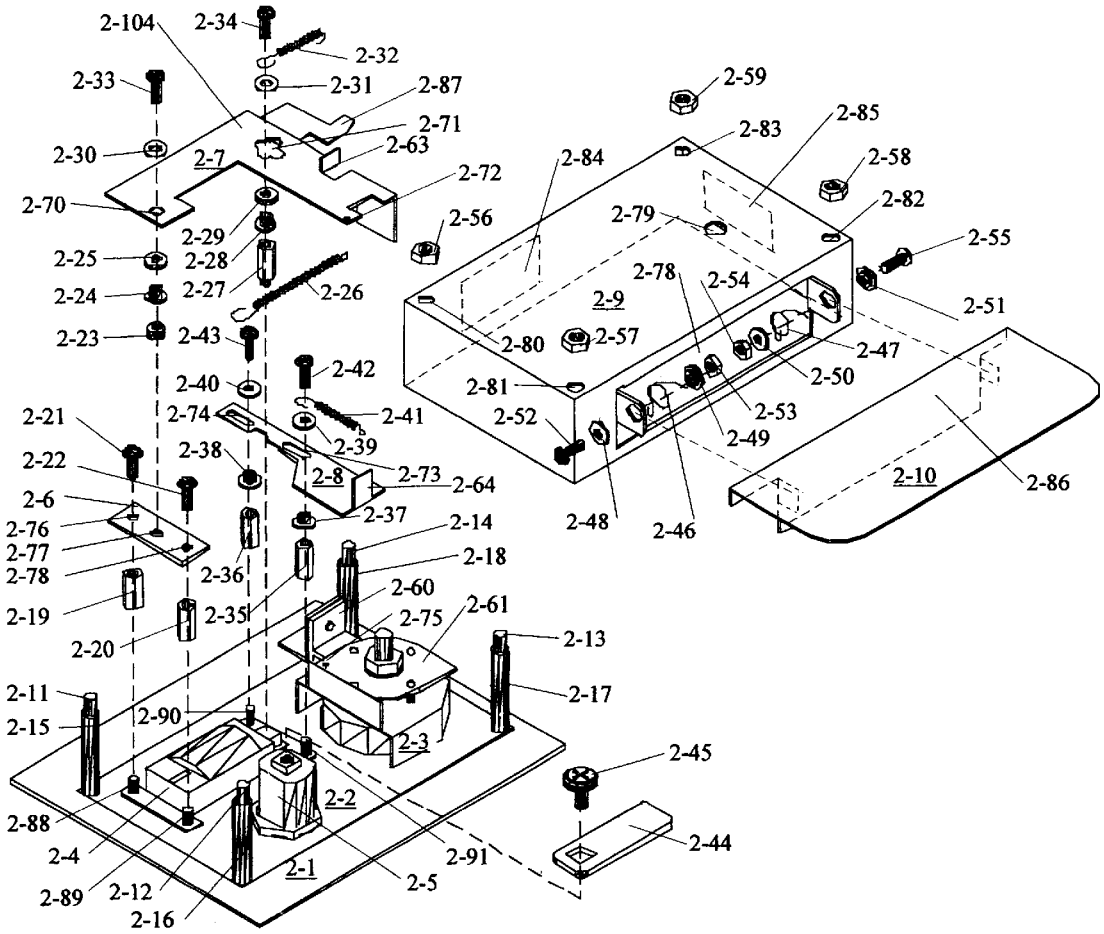
Figures 2, 3, 4:
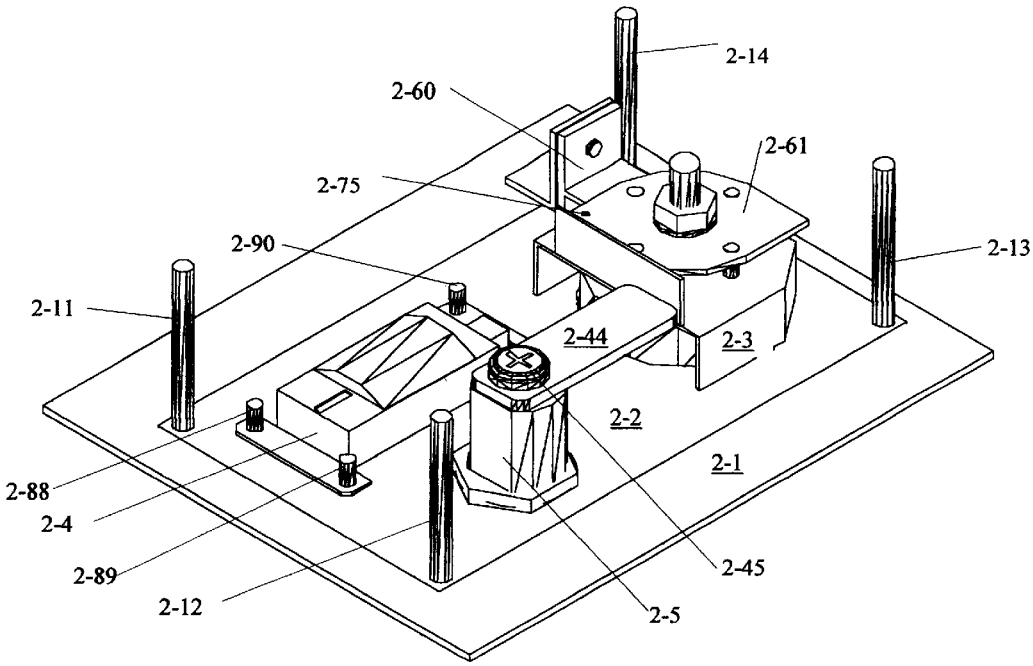
Figures 2, 3, 4, 5:
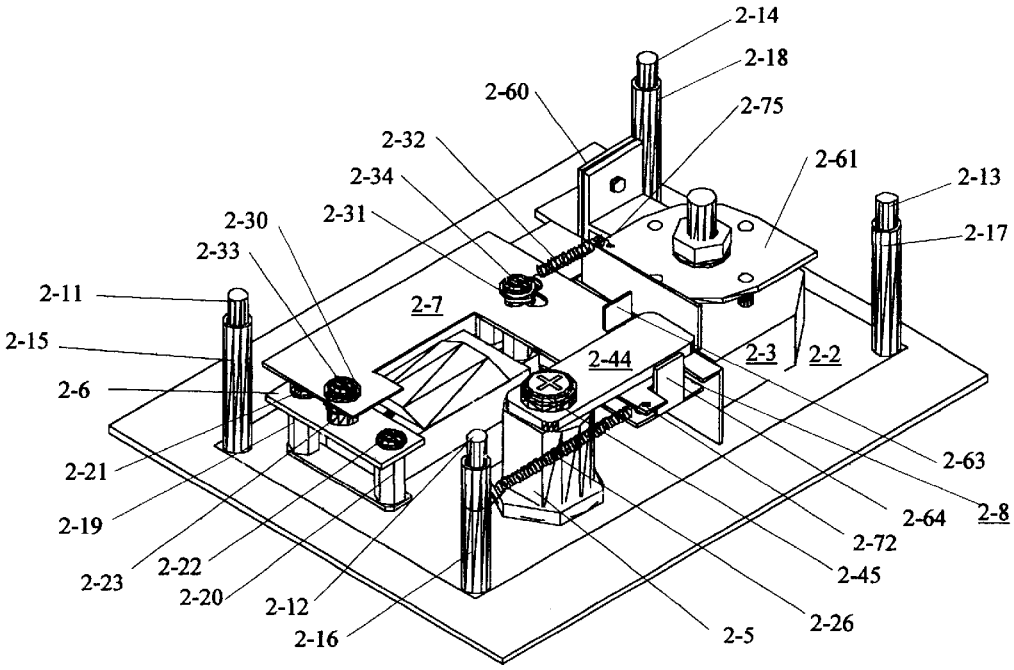
Figures 2, 3, 4, 5, 6:
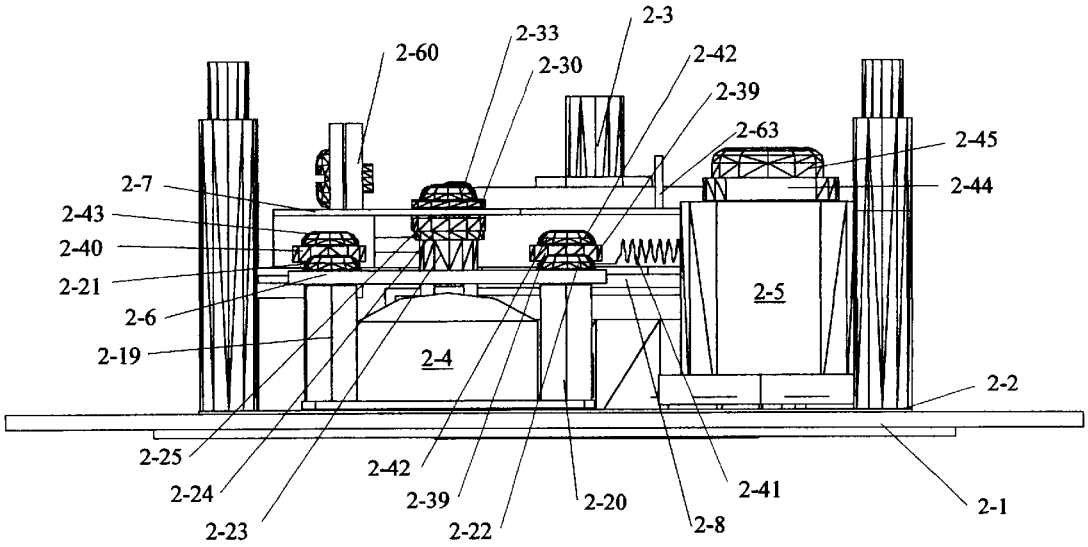
Figures 2, 3, 4, 5, 6, 7:
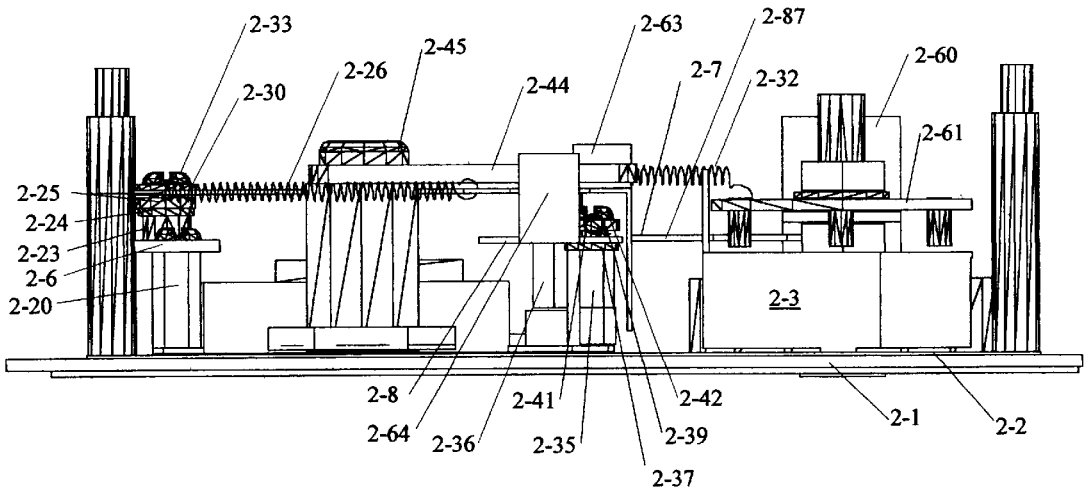
Figures 2, 3, 4, 5, 6, 7, 8:
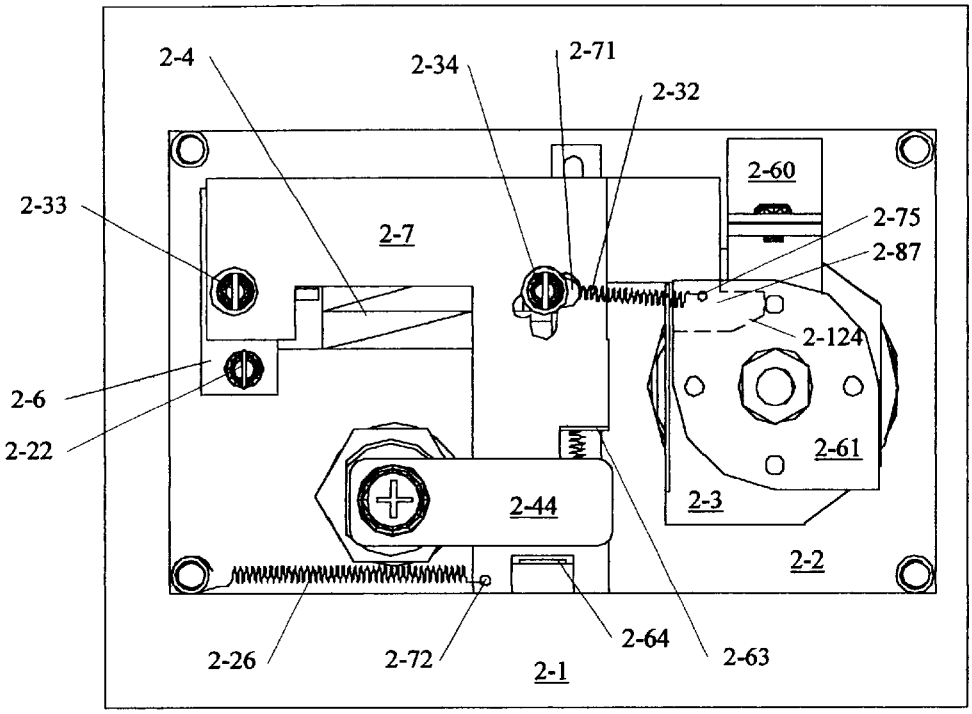
Figures 2, 3, 4, 5, 6, 7, 8, 9:
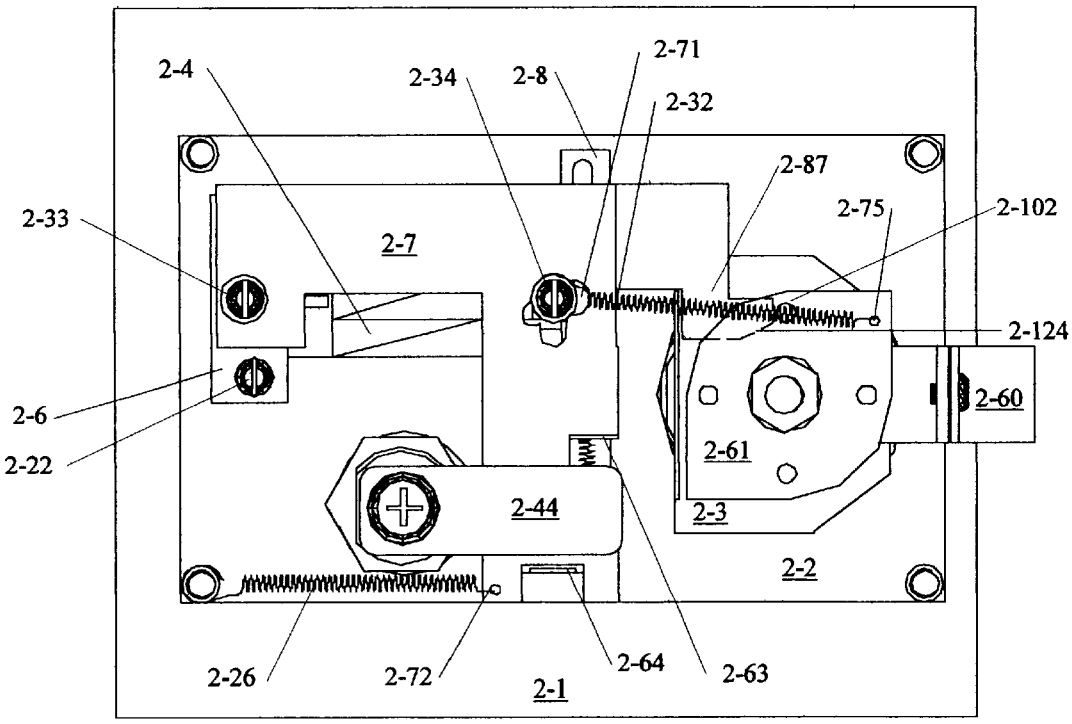
Figures 2, 3, 4, 5, 6, 7, 8, 9, 10:
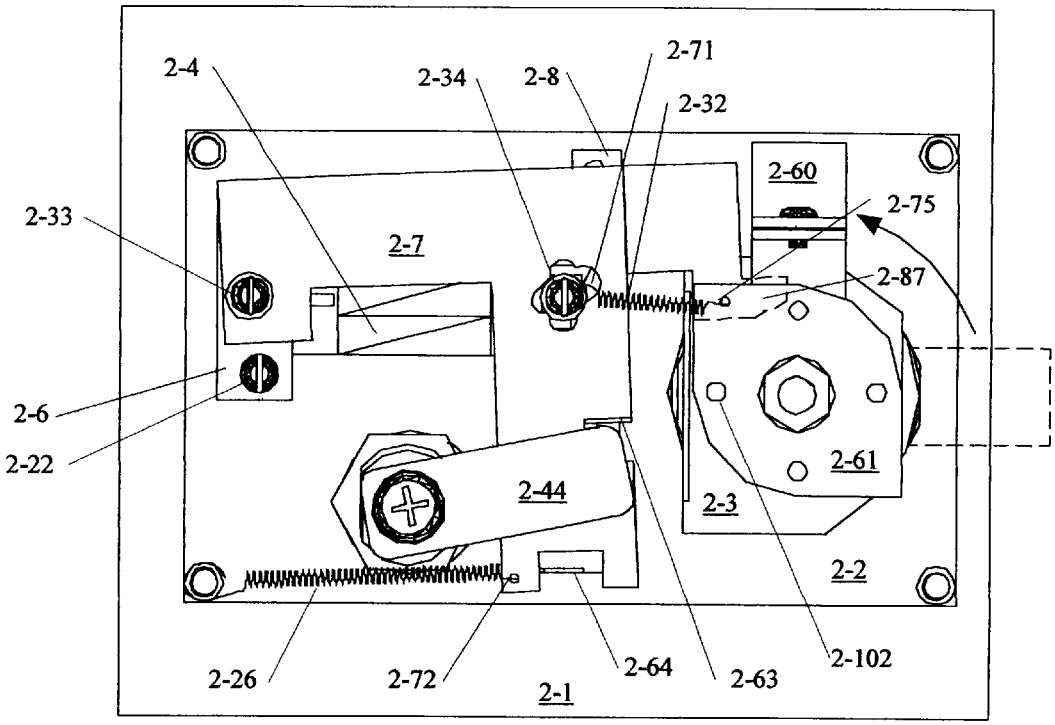
Figures 2, 3, 4, 5, 6, 7, 8, 9, 10, 11:
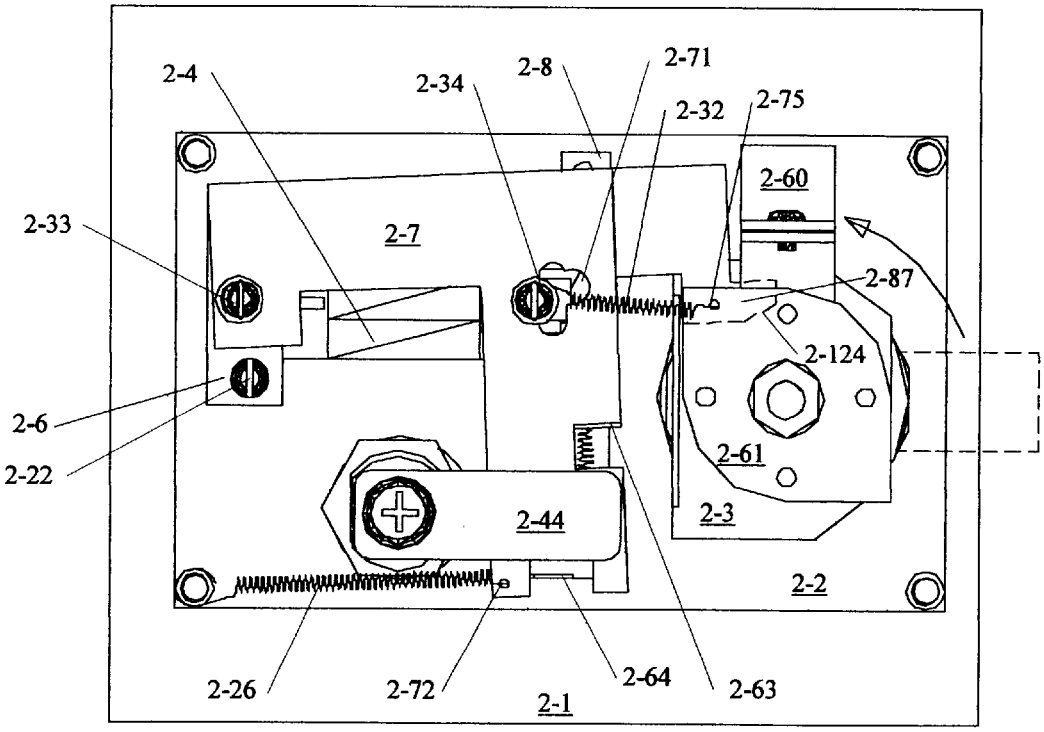
Figures 2, 3, 4, 5, 6, 7, 8, 9, 10, 11, 12:
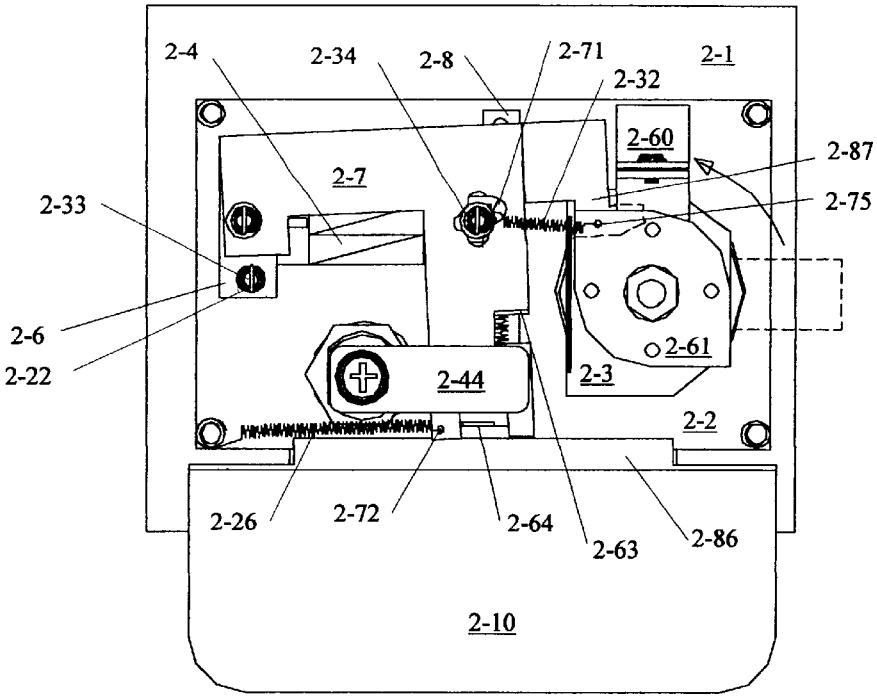
Figures 2, 3, 4, 5, 6, 7, 8, 9, 10, 11, 12, 13:
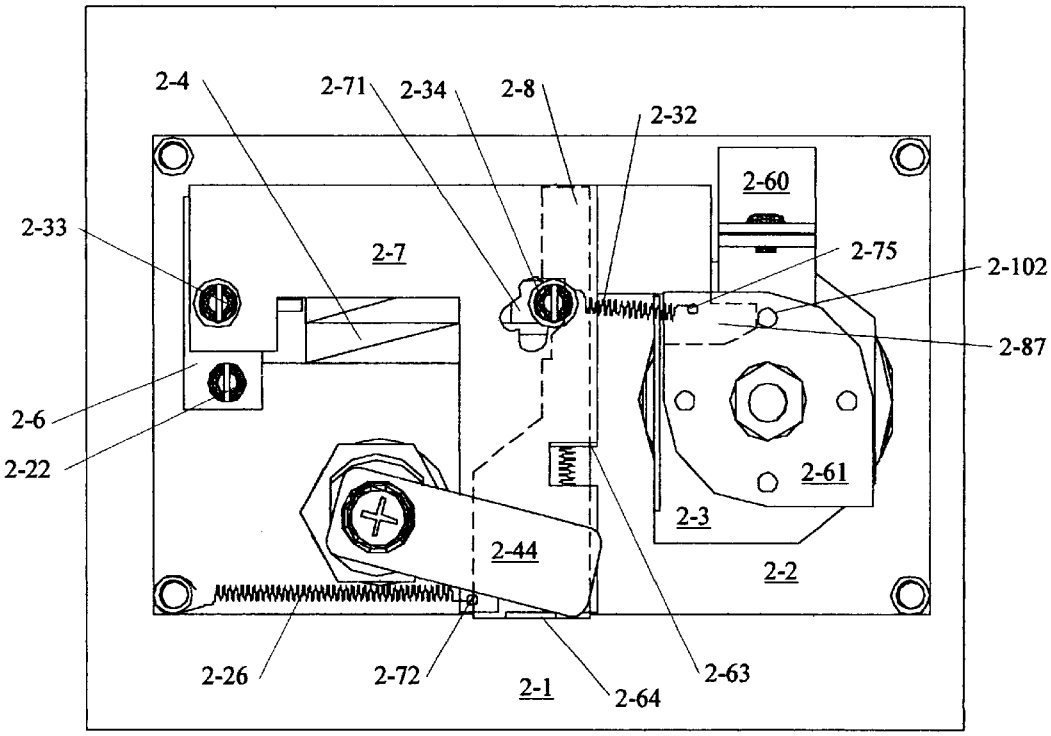
Figures 1, 3:
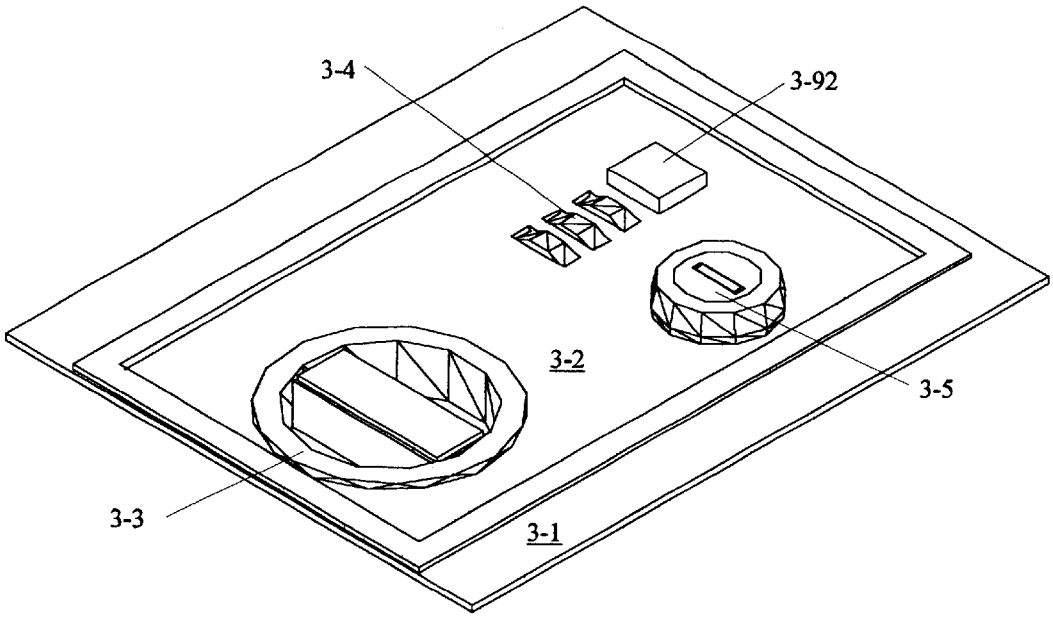
Figures 2, 3:
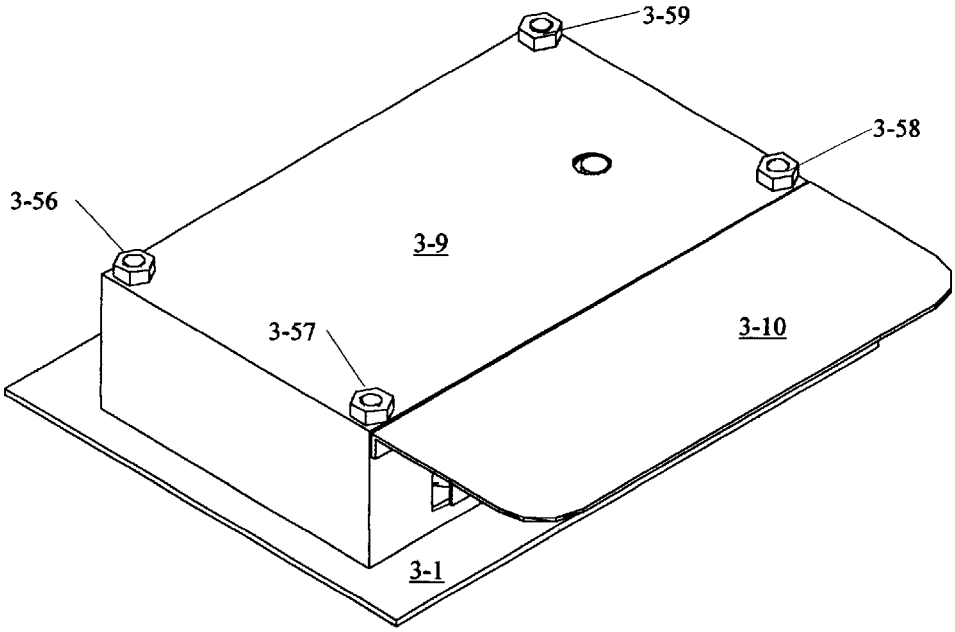
Figure 3:
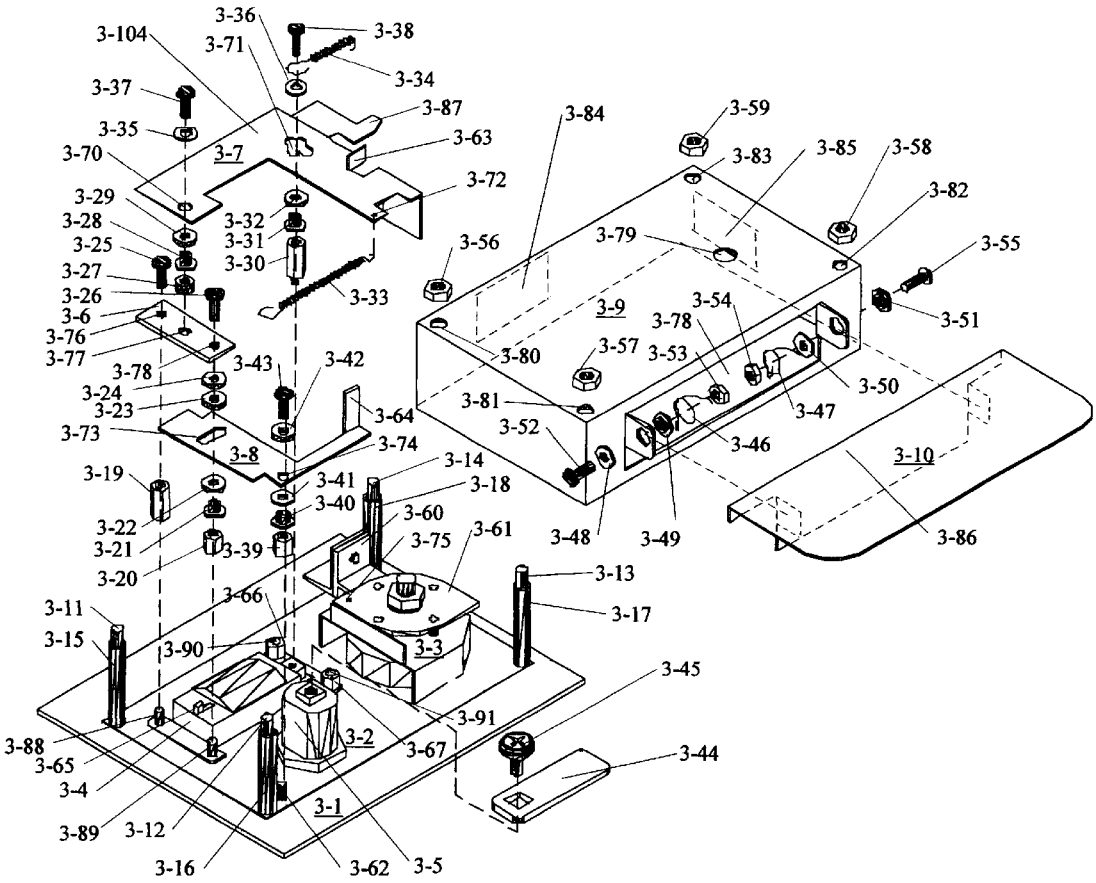
Figures 3, 4:
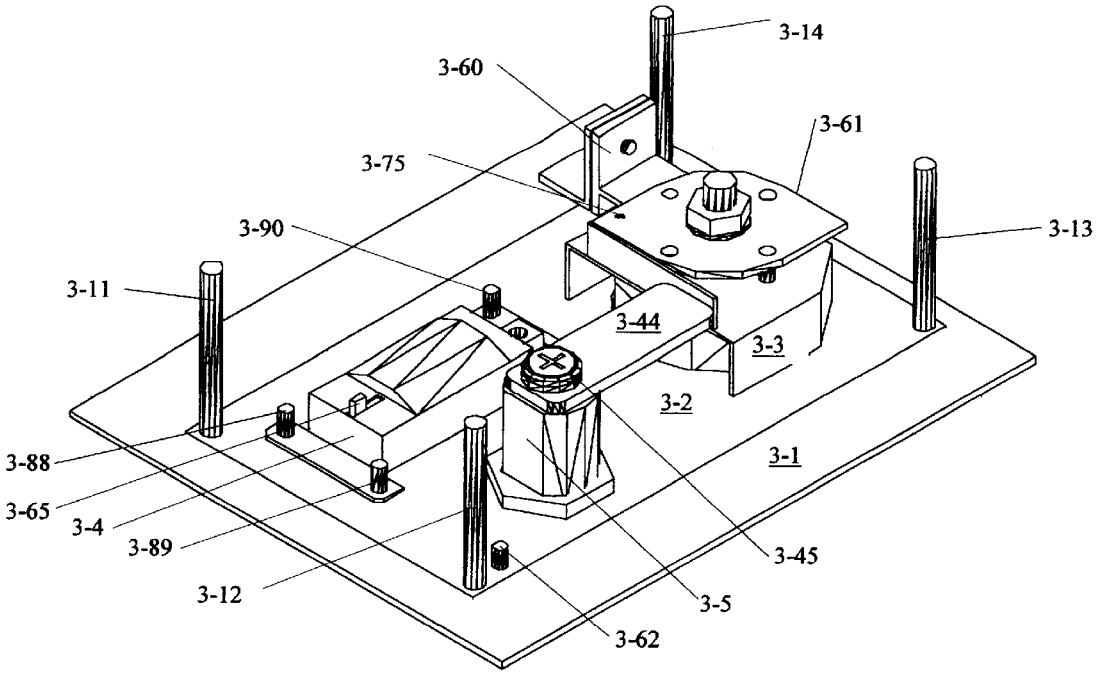
Figures 3, 4, 5:
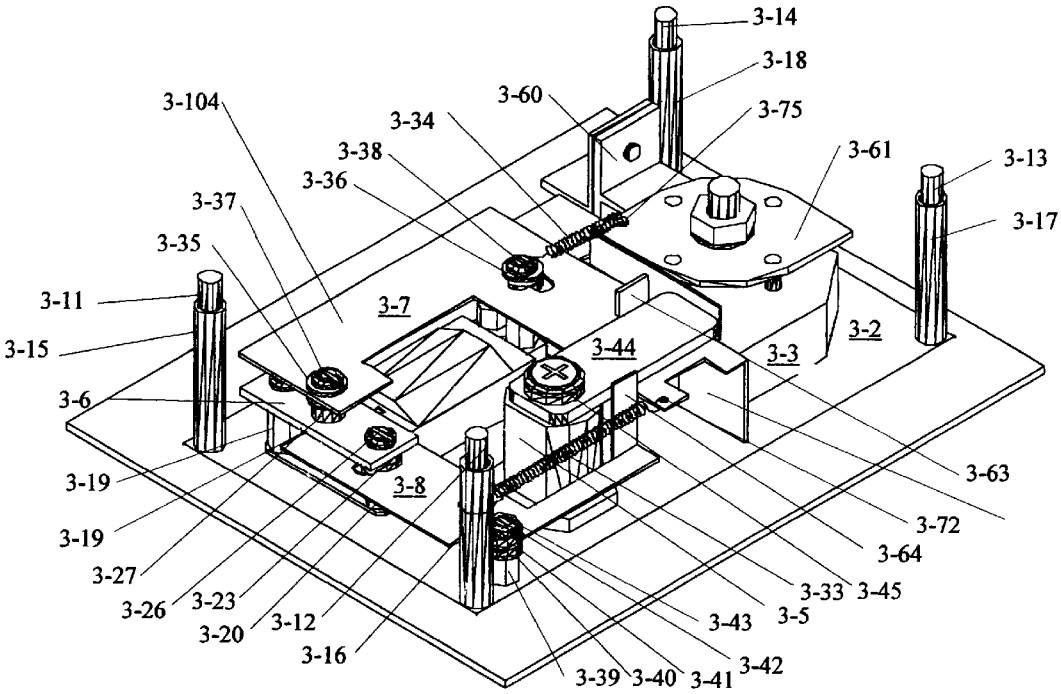
Figures 3, 4, 5, 6:
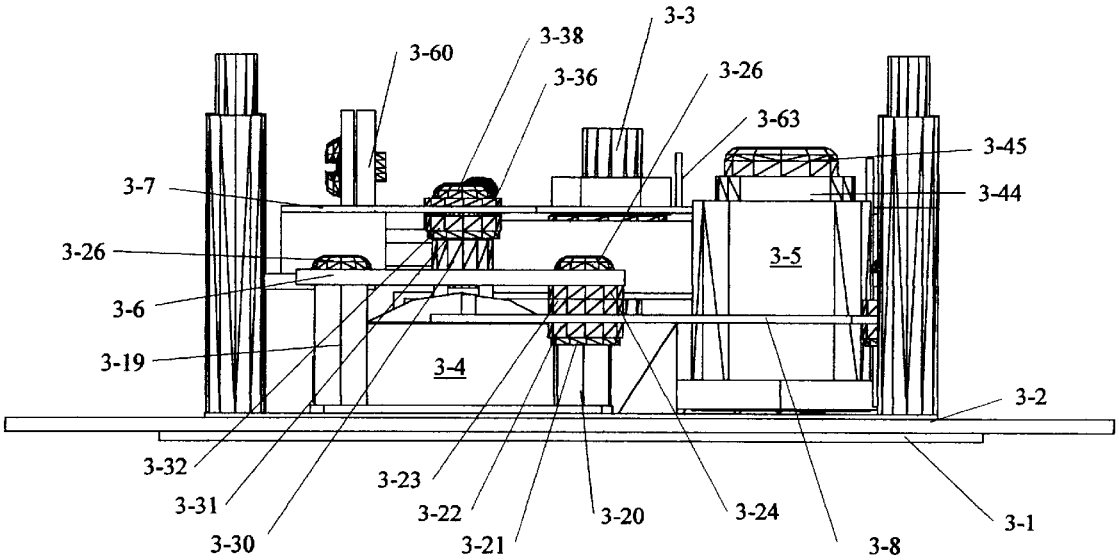
Figures 3, 4, 5, 6, 7:
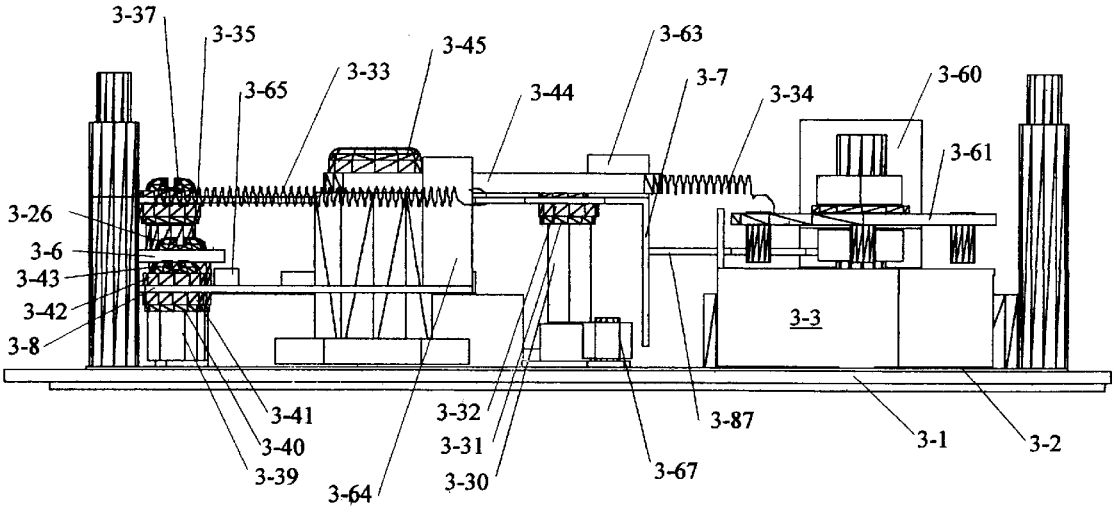
Figures 3, 4, 5, 6, 7, 8:
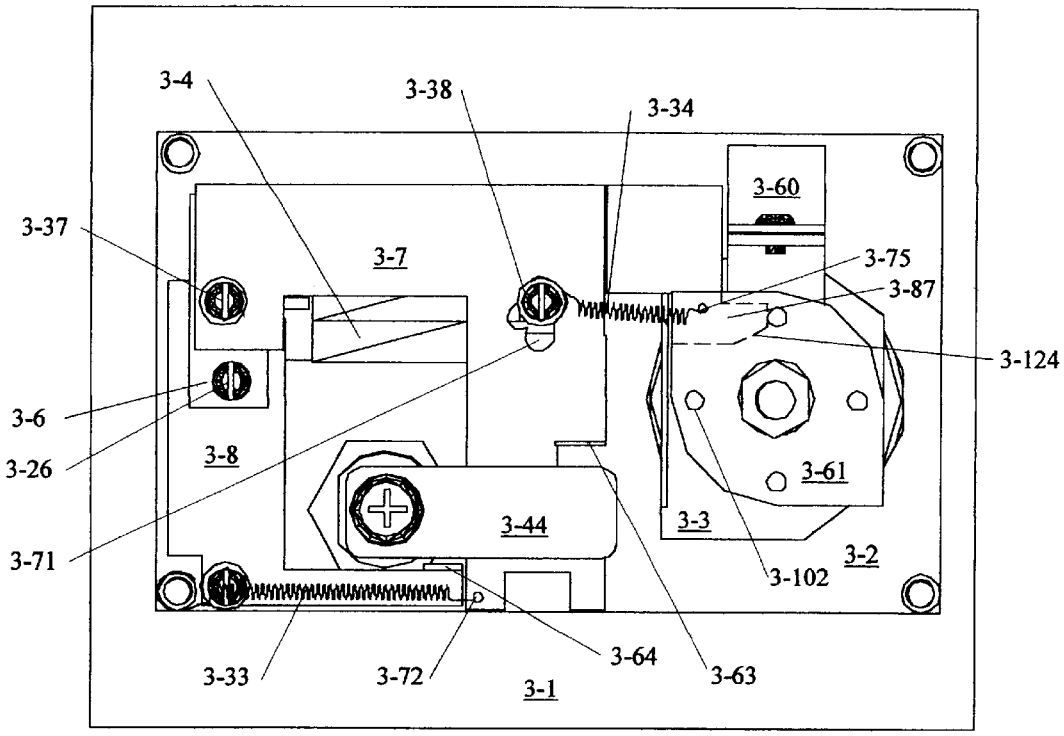
Figures 3, 4, 5, 6, 7, 8, 9:
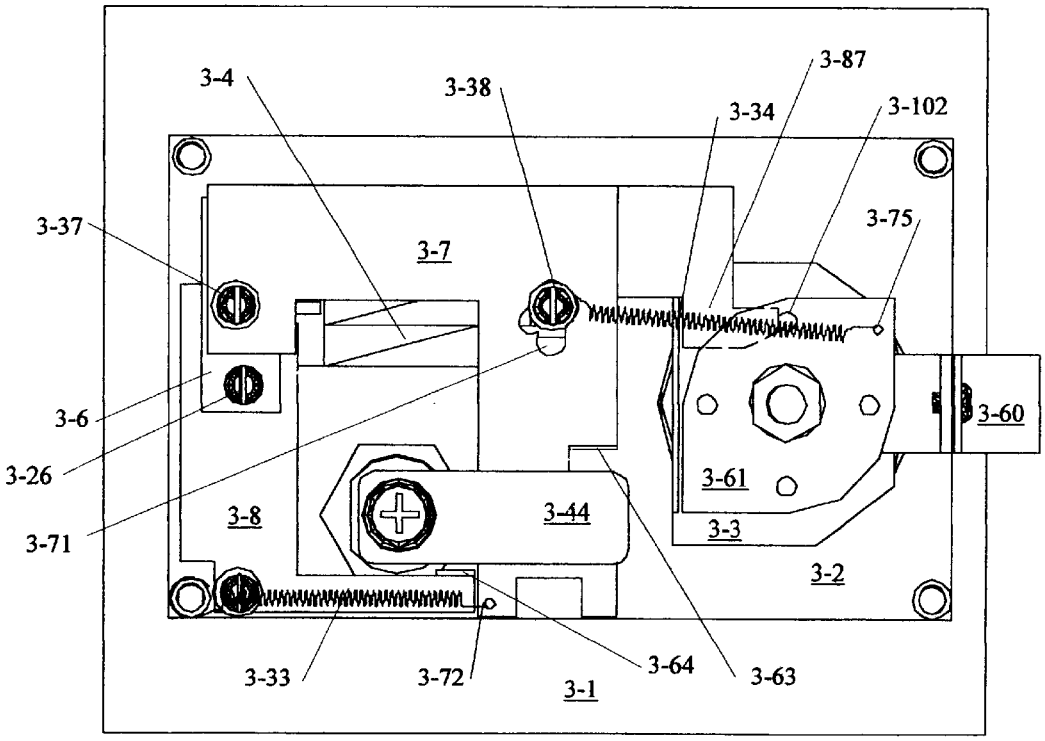
Figures 3, 4, 5, 6, 7, 8, 9, 10:
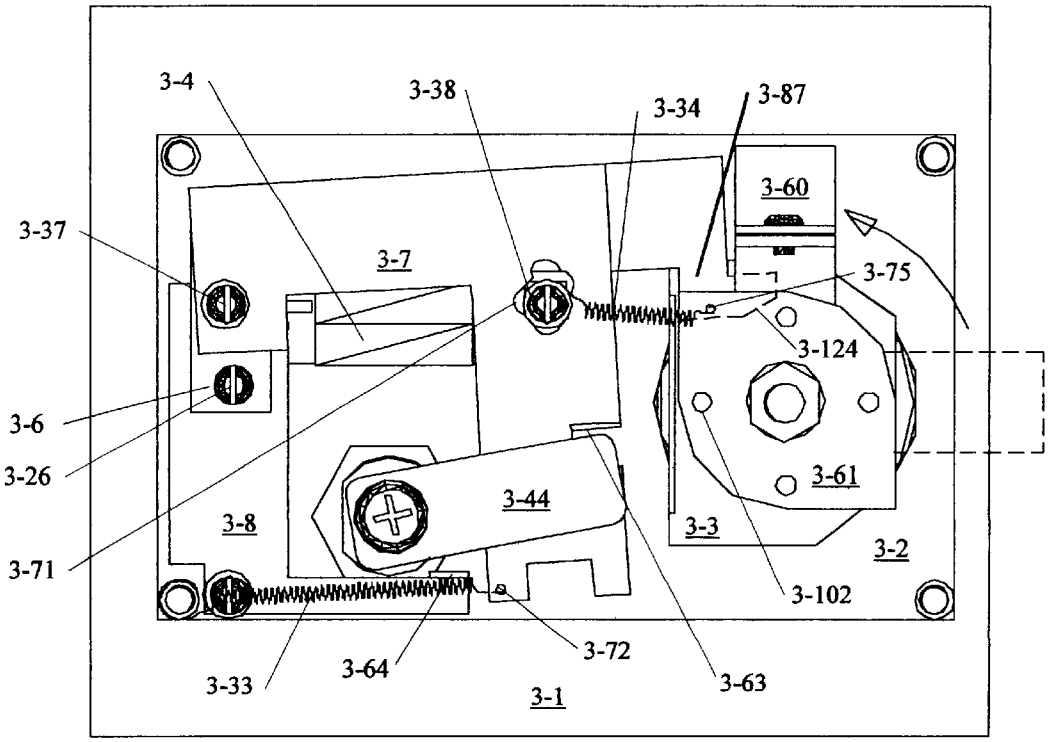
Figures 3, 4, 5, 6, 7, 8, 9, 10, 11:
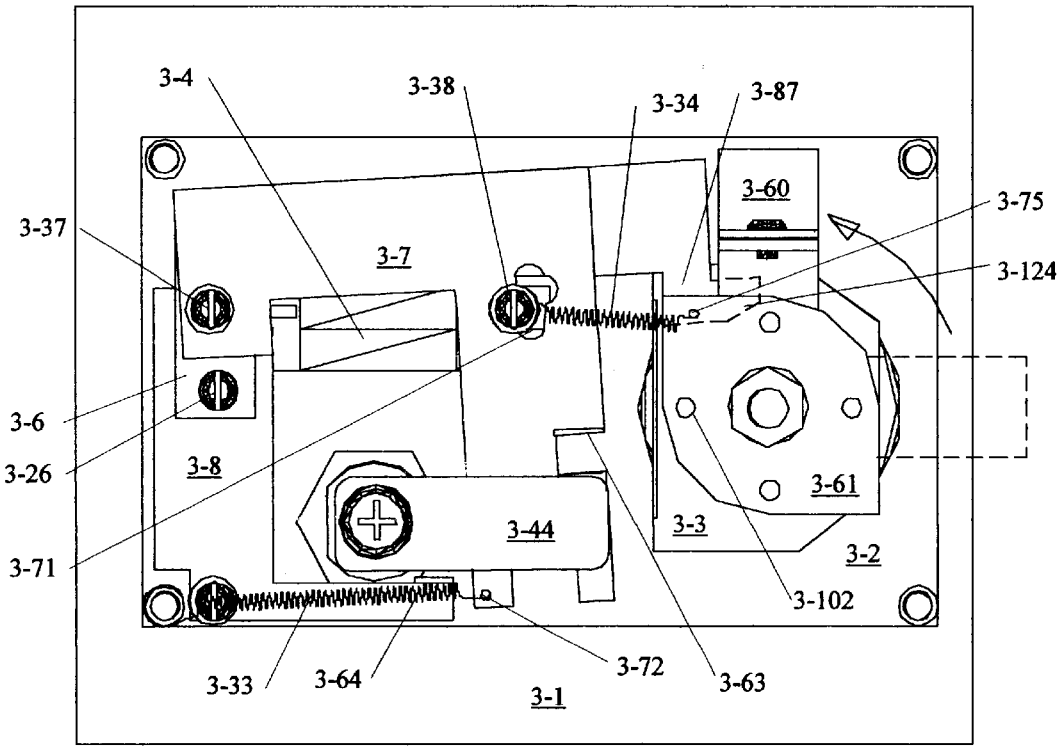
Figures 3, 4, 5, 6, 7, 8, 9, 10, 11, 12:
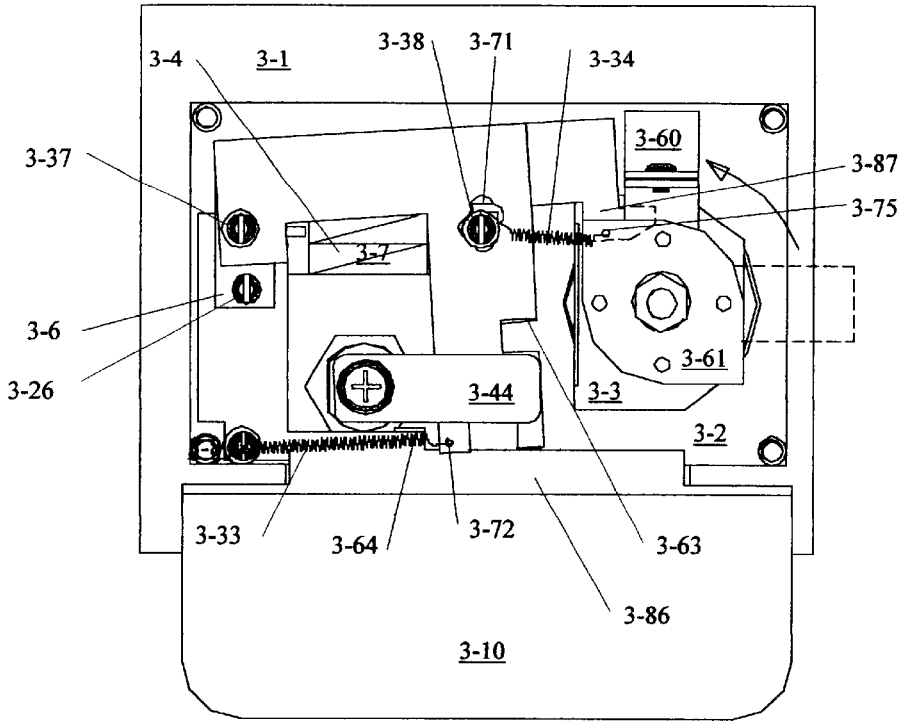
Figures 3, 4, 5, 6, 7, 8, 9, 10, 11, 12, 13:
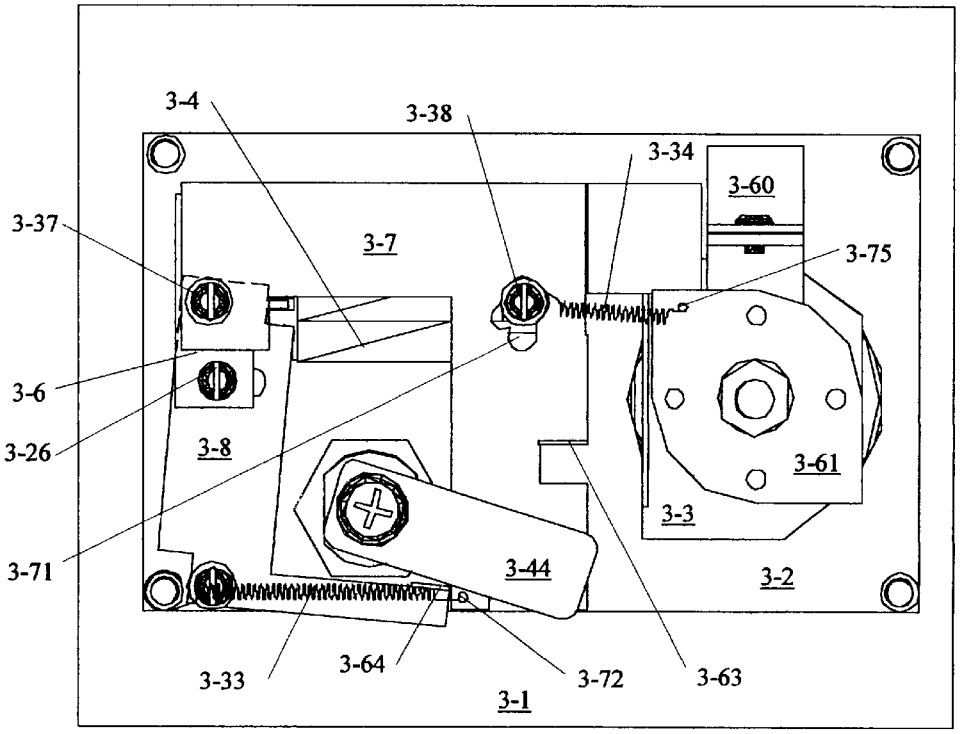

FIG. 3-5 shows an isometric view of the complete assembly with the cover 3-9 and emergency release paddle 3-10 removed. Item numbers are called out to assist in the understanding of the locking mechanism assembly.

FIGS. 3-6 and 3-7 show side views of the locking mechanism for ease of understanding the relationship between the levers and other components.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A secure delivery system for receiving and lockably storing tangible items delivered by a delivering party, said system comprising:

a lockable receptacle for receiving tangible items thereinto from a delivering party, said receptacle having a door;

a locking mechanism including a locking member, said locking mechanism being operational as a means for selectively locking the door of the receptacle by placing the locking member into an interference fit with a portion of the receptacle, to thereby inhibit unauthorized persons from opening said door;

a manually operable rotary latch disposed in communication with the locking mechanism for permitting users to enable the locking mechanism after the door of the receptacle is closed;

wherein the locking mechanism further comprises a locking lever, and three independent disengagement devices for selectively disengaging the locking member to thereby permit the door of the receptacle to be opened, wherein the three independent disengagement devices are each capable of independently disengaging the locking mechanism, wherein at least one of the three independent disengagement devices comprises:

a first means for disengaging the locking mechanism to thereby open the door of the receptacle, said first means comprising a combination locking device having readable combination symbols selectively changeable by a user from a first combination of symbols to a second combination of symbols, and an interlock lever having at least one engagement tab releasably disposed in engagement with a holding bar, and moving means for moving said holding bar out of engagement with the at least one engagement tab responsive to input of a correct combination by the user, and pushing means for pushing the interlock lever into engagement with the locking lever when the holding bar is moved out of engagement with the at least one engagement tab to thereby move said locking lever into an unlocked position to release the door.

2. The secure delivery system of claim 1, wherein the locking lever further comprises a chamfered engagement foot.

3. The secure delivery system of claim 2, wherein the chamfered engagement foot resides disposed in engagement with a moveable locking stud when the locking lever resides in a locked position.

4. The secure delivery system of claim 3, wherein the device further comprises a rotatably mounted stud plate attached to the locking stud, and wherein the locking lever and the rotatable stud plate are intercoupled with a spring.

5. The secure delivery system of claim 1, wherein the locking lever further comprises a main body, and a cam tab extending outwardly from said main body, and a chamfered engagement foot extending from said main body.

6. The secure delivery system of claim 5, wherein the main body further comprises an L-shaped portion having an opening formed therein for receiving a connector piece therethrough.

7. The secure delivery system of claim 1, wherein the at least one engagement tab of the interlock lever comprises a first engagement tab extending in a first lateral direction, and a second engagement tab extending in a second lateral direction, wherein the second engagement tab is disposed in alignment with the first engagement tab, and wherein the second lateral direction is opposite said first lateral direction.

8. The secure delivery system of claim 7, wherein the holding bar further comprises a T-shaped member having first and second engagement edges that reside in engagement with the first and second engagement tabs, respectively, when the locking lever is in a locked position.

9. The secure delivery system of claim 8, wherein the first and second engagement edges each have a width that is less than one-fourth of a width of the holding bar.

10. The secure delivery system of claim 1, wherein the pushing means further comprises a plurality of springs disposed in engagement with the interlock lever.

11. The secure delivery system of claim 10, wherein the springs are disposed in engagement with a ledge of the interlock lever.

12. The secure delivery system of claim 11, wherein the springs reside in a compressed arrangement when the locking lever resides in a locked position.

13. The secure delivery system of claim 4, wherein the stud plate is rotatably mounted about a substantially horizontal axis when the system is in operation.

14. The secure delivery system of claim 1, wherein the locking member resides in an interference fit with an engagement lip of the receptacle when the lock latch lever resides in a locked position.

15. The secure delivery system of claim 5, wherein one of the three independent disengagement devices comprises a second means for disengaging the locking mechanism to thereby open the door of the receptacle, said second means comprising a cam lock lever attached to a key receiving means for moving said cam lock lever into engagement with the locking lever responsive to insertion and turning of a key within the key receiving means to thereby move said locking lever into the unlocked position to release the door, wherein the cam lock lever is caused to move into engagement with the cam tab responsive to insertion and turning of the key, to thereby move said cam tab and locking lever upwardly.

16. The secure delivery system of claim 1, wherein one of the three independent disengagement devices comprises a third means for disengaging the locking mechanism to thereby open the door of the receptacle, said third means comprising a pivotally mounted paddle that is manually pivotable into engagement with the locking lever to thereby move said locking lever into the unlocked position to release the door, wherein the pivotally mounted paddle is mounted such that said paddle is manually pivotable into engagement with a lower portion of the locking lever to thereby move said locking lever into the unlocked position to release the door.

17. The secure delivery system of claim 3, wherein the chamfered engagement foot includes a chamfered edge that extends toward the locking stud when said locking stud is in the locked position, and wherein said chamfered engagement foot narrows in width in a lateral direction.

18. A locking device comprising:

a locking mechanism including a locking member, said locking mechanism being operational as a means for selectively locking a door of a receptacle by placing the locking member into an interference fit with a portion of the receptacle, to thereby inhibit unauthorized persons from opening said door;

a manually operable rotary latch disposed in communication with the locking mechanism for permitting a user to enable the locking mechanism after the door of the receptacle is closed;

wherein the locking mechanism further comprises a locking lever, and three independent disengagement devices for selectively disengaging the locking member to thereby permit the door of the receptacle to be opened, wherein the three independent disengagement devices are each capable of independently disengaging the locking mechanism, wherein the locking mechanism comprises:

a first means for disengaging the locking mechanism to thereby open the door of the receptacle, said first means comprising a combination locking device having readable combination symbols selectively changeable by the user from a first combination of symbols to a second combination of symbols, and an interlock lever having at least one engagement tab releasably disposed in engagement with a holding bar, and moving means for moving said holding bar out of engagement with the at least one engagement tab responsive to input of a correct combination by the user, and pushing means for pushing the interlock lever into engagement with the locking lever when the holding bar is moved out of engagement with the at least one engagement tab to thereby move said locking lever into an unlocked position to release the door;

a second means for disengaging the locking mechanism to thereby open the door of the receptacle, said second means comprising a cam lock lever attached to a key receiving means for moving said cam lock lever into engagement with the locking lever responsive to insertion and turning of a key within the key receiving means to thereby move said locking lever into the unlocked position to release the door; and a third means for disengaging the locking mechanism to thereby open the door of the receptacle, said third means comprising a pivotally mounted paddle that is manually pivotable into engagement with the locking lever to thereby move said locking lever into the unlocked position to release the door.

19. The locking device of claim 18:

wherein the locking lever further comprises a chamfered engagement foot;

wherein the chamfered engagement foot resides disposed in engagement with a moveable locking stud when the locking lever resides in a locked position;

a rotatably mounted stud plate attached to the locking stud, wherein the locking lever and the rotatable stud plate are intercoupled with a spring;

wherein the locking lever further comprises a main body, and a cam tab, wherein the cam tab and the chamfered engagement foot extend outwardly from said main body;

wherein the main body further comprises an L-shaped portion having an opening formed therein for receiving a connector piece therethrough;

wherein the at least one engagement tab of the interlock lever comprises a first engagement tab extending in a first lateral direction, and a second engagement tab extending in a second lateral direction, wherein the second engagement tab is disposed in alignment with the first engagement tab, and wherein the second lateral direction is opposite said first lateral direction;

wherein the holding bar further comprises a T-shaped member having first and second engagement edges that reside in engagement with the first and second engagement tabs, respectively, when the locking lever is in the locked position;

wherein the engagement edges have a width that is less than one-fourth of a width of the holding bar;

wherein the pushing means further comprises a plurality of springs disposed in engagement with the interlock lever;

wherein the springs are disposed in engagement with a ledge of the interlock lever;

wherein the springs reside in a compressed arrangement when the locking lever resides in the locked position;

wherein the stud plate is rotatably mounted about a substantially horizontal axis when the system is in operation;

wherein the locking member is configured and dimensioned to reside in an interference fit with an external structure when the lock latch lever resides in a locked position;

wherein the cam lock lever is caused to move into engagement with the cam tab responsive to insertion and turning of the key, to thereby move said cam tab and locking lever upwardly;

wherein the pivotally mounted paddle is mounted such that said paddle is manually pivotable into engagement with a lower portion of the locking lever to thereby move said locking lever into the unlocked position to release the door;

wherein the chamfered engagement foot includes a chamfered edge that extends toward the locking stud when said locking stud is in the locked position, and wherein said chamfered engagement foot narrows in width in a lateral direction.

20. A secure delivery system for receiving and lockably storing tangible items delivered by a delivering party, said system comprising:

a lockable receptacle for receiving tangible items thereinto from a delivering party, said receptacle having a door and an engagement lip;

a locking mechanism including a locking member, said locking mechanism being operational as a means for selectively locking the door of the receptacle by placing the locking member into an interference fit with the engagement lip of the receptacle, to thereby inhibit unauthorized persons from opening said door;

a manually operable rotary latch disposed in communication with the locking mechanism for permitting a user to enable the locking mechanism after the door of the receptacle is closed;

wherein the locking mechanism further comprises a locking lever, and three independent disengagement devices for selectively disengaging the locking member to thereby permit the door of the receptacle to be opened, wherein the three independent disengagement devices are each capable of independently disengaging the locking mechanism, wherein the locking mechanism comprises:

a first means for disengaging the locking mechanism to thereby open the door of the receptacle, said first means comprising a combination locking device having readable combination symbols selectively changeable by the user from a first combination of symbols to a second combination of symbols, and an interlock lever having at least one engagement tab releasably disposed in engagement with a holding bar, and moving means for moving said holding bar out of engagement with the at least one engagement tab responsive to input of a correct combination by the user, and pushing means for pushing the interlock lever into engagement with the locking lever when the holding bar is moved out of engagement with the at least one engagement tab to thereby move said locking lever into an unlocked position to release the door;

a second means for disengaging the locking mechanism to thereby open the door of the receptacle, said second means comprising a cam lock lever attached to a key receiving means for moving said cam lock lever into engagement with the locking lever responsive to insertion and turning of a key within the key receiving means to thereby move said locking lever into the unlocked position to release the door; and a third means for disengaging the locking mechanism to thereby open the door of the receptacle, said third means comprising a pivotally mounted paddle that is manually pivotable into engagement with the locking lever to thereby move said locking lever into the unlocked position to release the door;

wherein the locking lever further comprises a chamfered engagement foot;

wherein the chamfered engagement foot resides disposed in engagement with a moveable locking stud when the locking lever resides in a locked position;

a rotatably mounted stud plate attached to the locking stud, wherein the locking lever and the rotatable stud plate are intercoupled with a spring;

wherein the locking lever further comprises a main body, and a cam tab, wherein the cam tab and the chamfered engagement foot extend outwardly from said main body;

wherein the main body further comprises an L-shaped portion having an opening formed therein for receiving a connector piece therethrough;

wherein the at least one engagement tab of the interlock lever comprises a first engagement tab extending in a first lateral direction, and a second engagement tab extending in a second lateral direction, wherein the second engagement tab is disposed in alignment with the first engagement tab, and wherein the second lateral direction is opposite said first lateral direction;

wherein the holding bar further comprises a T-shaped member having first and second engagement edges that reside in engagement with the first and second engagement tabs, respectively, when the locking lever is in the locked position; wherein the engagement edges have a width that is less than one-fourth of a width of the holding bar;

wherein the pushing means further comprises a plurality of springs disposed in engagement with the interlock lever;

wherein the springs are disposed in engagement with a ledge of the interlock lever;

wherein the springs reside in a compressed arrangement when the locking lever resides in the locked position;

wherein the stud plate is rotatably mounted about a substantially horizontal axis when the system is in operation;

wherein the cam lock lever is caused to move into engagement with the cam tab responsive to insertion and turning of the key, to thereby move said cam tab and locking lever upwardly;

wherein the pivotally mounted paddle is mounted such that said paddle is manually pivotable into engagement with a lower portion of the locking lever to thereby move said locking lever into the unlocked position to release the door;

wherein the chamfered engagement foot includes a chamfered edge that extends toward the locking stud when said locking stud is in the locked position, and wherein said chamfered engagement foot narrows in width in a lateral direction.

21. A secure delivery system for receiving and lockably storing tangible items delivered by a delivering party, said system comprising:

a lockable receptacle for receiving tangible items thereinto from a delivering party, said receptacle having a door;

a locking mechanism including a locking member, said locking mechanism being operational as a means for selectively locking the door of the receptacle by placing the locking member into an interference fit with a portion of the receptacle, to thereby inhibit unauthorized persons from opening said door;

a manually operable rotary latch disposed in communication with the locking mechanism for permitting users to enable the locking mechanism after the door of the receptacle is closed;

wherein the locking mechanism further comprises a locking lever, and three independent disengagement devices for selectively disengaging the locking member to thereby permit the door of the receptacle to be opened, wherein the three independent disengagement devices are each capable of independently disengaging the locking mechanism, wherein the three independent disengagement devices comprise:

a first means for disengaging the locking mechanism to thereby open the door of the receptacle, said first means comprising a combination locking device having readable combination symbols selectively changeable by a user from a first combination of symbols to a second combination of symbols, and an interlock lever having at least one engagement tab releasably disposed in engagement with a holding bar, and moving means for moving said holding bar out of engagement with the at least one engagement tab responsive to input of a correct combination by the user, and pushing means for pushing the interlock lever into engagement with the locking lever when the holding bar is moved out of engagement with the at least one engagement tab to thereby move said locking lever into an unlocked position to release the door;

a second means for disengaging the locking mechanism to thereby open the door of the receptacle, said second means comprising a cam lock lever attached to a key receiving means for moving said cam lock lever into engagement with the locking lever responsive to insertion and turning of a key within the key receiving means to thereby move said locking lever into the unlocked position to release the door; and a third means for disengaging the locking mechanism to thereby open the door of the receptacle, said third means comprising a pivotally mounted paddle that is manually pivotable into engagement with the locking lever to thereby move said locking lever into the unlocked position to release the door.

22. The secure delivery system of claim 21, wherein the locking lever further comprises a chamfered engagement foot.

23. The secure delivery system of claim 22, wherein the chamfered engagement foot resides disposed in engagement with a moveable locking stud when the locking lever resides in a locked position.

24. The secure delivery system of claim 23, wherein the device further comprises a rotatably mounted stud plate attached to the locking stud, and wherein the locking lever and the rotatable stud plate are intercoupled with a spring.

25. The secure delivery system of claim 21, wherein the locking lever further comprises a main body, and a cam tab extending outwardly from said main body, and a chamfered engagement foot extending from said main body.

26. The secure delivery system of claim 25, wherein the main body further comprises an L-shaped portion having an opening formed therein for receiving a connector piece therethrough.

27. The secure delivery system of claim 21, wherein the at least one engagement tab of the interlock lever comprises a first engagement tab extending in a first lateral direction, and a second engagement tab extending in a second lateral direction, wherein the second engagement tab is disposed in alignment with the first engagement tab, and wherein the second lateral direction is opposite said first lateral direction.

28. The secure delivery system of claim 27, wherein the holding bar further comprises a T-shaped member having first and second engagement edges that reside in engagement with the first and second engagement tabs, respectively, when the locking lever is in a locked position.

29. The secure delivery system of claim 28, wherein the first and second engagement edges each have a width that is less than one-fourth of a width of the holding bar.

30. The secure delivery system of claim 21, wherein the pushing means further comprises a plurality of springs disposed in engagement with the interlock lever.

31. The secure delivery system of claim 30, wherein the springs are disposed in engagement with a ledge of the interlock lever.

32. The secure delivery system of claim 31, wherein the springs reside in a compressed arrangement when the locking lever resides in a locked position.

33. The secure delivery system of claim 24, wherein the stud plate is rotatably mounted about a substantially horizontal axis when the system is in operation.

34. The secure delivery system of claim 21, wherein the locking member resides in an interference fit with an engagement lip of the receptacle when the lock latch lever resides in a locked position.

35. The secure delivery system of claim 25, wherein the cam lock lever is caused to move into engagement with the cam tab responsive to insertion and turning of the key, to thereby move said cam tab and locking lever upwardly.

36. The secure delivery system of claim 21, wherein the pivotally mounted paddle is mounted such that said paddle is manually pivotable into engagement with a lower portion of the locking lever to thereby move said locking lever into the unlocked position to release the door.

37. The secure delivery system of claim 23, wherein the chamfered engagement foot includes a chamfered edge that extends toward the locking stud when said locking stud is in the locked position, and wherein said chamfered engagement foot narrows in width in a lateral direction.

38. A locking device comprising:

a locking mechanism including a locking member, said locking mechanism being operational as a means for selectively locking a door of a receptacle by placing the locking member into an interference fit with a portion of the receptacle, to thereby inhibit unauthorized persons from opening said door;

a manually operable rotary latch disposed in communication with the locking mechanism for permitting a user to enable the locking mechanism after the door of the receptacle is closed;

wherein the locking mechanism further comprises a locking lever, and three independent disengagement devices for selectively disengaging the locking member to thereby permit the door of the receptacle to be opened, wherein the three independent disengagement devices are each capable of independently disengaging the locking mechanism, wherein the locking mechanism comprises:

a first means for disengaging the locking mechanism to thereby open the door of the receptacle, said first means comprising a combination locking device having readable combination symbols selectively changeable by the user from a first combination of symbols to a second combination of symbols, and an interlock lever having at least one engagement tab releasably disposed in engagement with a holding bar, and moving means for moving said holding bar out of engagement with the at least one engagement tab responsive to input of a correct combination by the user, and pushing means for pushing the interlock lever into engagement with the locking lever when the holding bar is moved out of engagement with the at least one engagement tab to thereby move said locking lever into an unlocked position to release the door.

39. The locking device of claim 38, wherein the locking mechanism further comprises a second means for disengaging the locking mechanism to thereby open the door of the receptacle, said second means comprising a cam lock lever attached to a key receiving means for moving said cam lock lever into engagement with the locking lever responsive to insertion and turning of a key within the key receiving means to thereby move said locking lever into the unlocked position to release the door.

40. The locking device of claim 38, wherein the locking mechanism further comprises a third means for disengaging the locking mechanism to thereby open the door of the receptacle, said third means comprising a pivotally mounted paddle that is manually pivotable into engagement with the locking lever to thereby move said locking lever into the unlocked position to release the door.

* * * * *